US011611164B2

(12) United States Patent
Jiang et al.

(10) Patent No.: US 11,611,164 B2
(45) Date of Patent: Mar. 21, 2023

(54) WIDEBAND MULTI-PIN EDGE CONNECTOR FOR RADIO FREQUENCY FRONT END MODULE

(71) Applicant: Intel Corporation, Santa Clara, CA (US)

(72) Inventors: Zhenguo Jiang, Chandler, AZ (US); Omkar Karhade, Chandler, AZ (US); Sri Chaitra Chavali, Chandler, AZ (US); William Lambert, Tempe, AZ (US); Zhichao Zhang, Chandler, AZ (US); Mitul Modi, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 670 days.

(21) Appl. No.: 16/454,439

(22) Filed: Jun. 27, 2019

(65) Prior Publication Data

US 2020/0412041 A1 Dec. 31, 2020

(51) Int. Cl.

| | |
|---|---|
| ***H01R 12/72*** | (2011.01) |
| ***H01R 12/77*** | (2011.01) |
| ***H01R 13/40*** | (2006.01) |
| ***H01R 13/24*** | (2006.01) |
| ***H01R 13/6471*** | (2011.01) |
| ***H01R 107/00*** | (2006.01) |

(52) U.S. Cl.

CPC ..... *H01R 12/727* (2013.01); *H01R 12/77* (2013.01); *H01R 13/2457* (2013.01); *H01R 13/40* (2013.01); *H01R 13/6471* (2013.01); *H01R 2107/00* (2013.01)

(58) Field of Classification Search

CPC ..... H01R 13/6471; H01R 2107/00; H01R 13/6474; H01R 12/727

See application file for complete search history.

(56) References Cited

U.S. PATENT DOCUMENTS

| | | | | |
|---|---|---|---|---|
| 6,575,789 | B2 * | 6/2003 | Bassler | H01R 9/0512 439/108 |
| 7,794,240 | B2 * | 9/2010 | Cohen | H01R 13/6471 439/78 |
| 7,811,100 | B2 * | 10/2010 | Stoner | H01R 13/6471 439/108 |
| 9,444,189 | B1 * | 9/2016 | Sattazahn | H01R 13/6471 |
| 9,461,423 | B2 * | 10/2016 | Tsai | H01R 12/724 |
| 9,472,900 | B1 * | 10/2016 | Phillips | H01R 13/6471 |
| 11,189,971 | B2 * | 11/2021 | Lu | H01R 12/75 |

* cited by examiner

*Primary Examiner* — Briggitte R. Hammond

(74) *Attorney, Agent, or Firm* — Essential Patents Group, LLP.

(57) ABSTRACT

A wide bandwidth signal connector plug, comprising a plurality of signal pins having a first anchor portion and a first mating portion, and a plurality of ground pins having a second anchor portion and a second mating portion. The plurality of ground pins is adjacent to the plurality of signal pins. The plurality of signal pins has a first thickness and the plurality of ground pins has a second thickness that is greater than the first thickness. The first anchor portion has a first width and the second anchor portion has a second width that is greater than the first width.

21 Claims, 12 Drawing Sheets

WIDEBAND MULTI-PIN EDGE CONNECTOR FOR RADIO FREQUENCY FRONT END MODULE

BACKGROUND 5G ($5^{th}$ Generation) wireless communication technology by mobile networks is imminent. Data bandwidths greatly exceed 30 GHz, and may be 70 GHz or higher. These so-called millimeter-wave data bandwidths, encompassing bandwidths of 30 to 300 GHz, soon are to become the next-generation standard that will power ultra-rapid file downloads of 20 gigabytes per second or higher, high-definition (e.g., 4K) video streaming with latencies of 10 milliseconds or less, and the Internet of Things (IoT). Efficient handling of high-speed digital and wideband radio frequency (RF) signals above 30 GHz require advances in intra-board and inter-board signal routing. State-of-the-art board architectures and components are designed for sub-6 GHz bandwidths used by LTE (Long Term Evolution, 4G), and are generally inadequate for handling millimeter-wave data bandwidths with sufficient fidelity. In particular, data transfer bandwidth between circuit boards is limited to less than 10 GHz by conventional RF edge connectors employed in cable-to-board and board-to-board interconnections.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
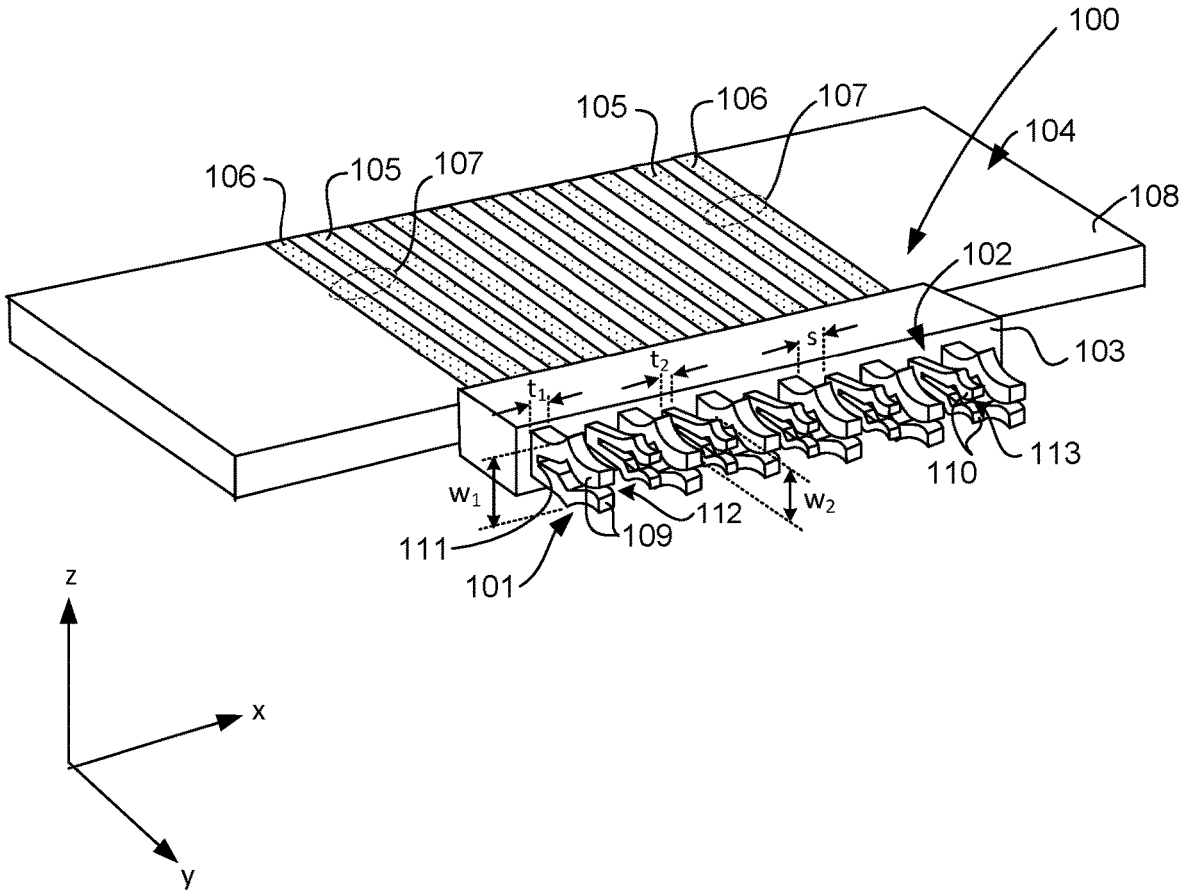
FIG. 1 illustrates an oblique view of a millimeter-wave multi-pin (MWMP) edge connector socket integrated onto the edge of a circuit board, according to some embodiments of the disclosure.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Here, the term "5G" generally refers to 5th Generation wireless networking protocol.

Here, the term "bandwidth" generally refers to a range of radio frequencies due to the spread of sidebands around a carrier frequency, where the sidebands result from the type of carrier modulation (e.g., continuous wave modulation, amplitude modulation or frequency modulation). High frequency data transmissions having rates of one or more gigabits per second (Gbps) may have a bandwidth of several gigahertz (GHz). The bandwidth of a particular type of radio transmission generally depends on the type of modulation. As an example, the 5G standard calls for channel bandwidths of up to 400 megahertz (MHz) for carrier frequencies of a 26.5 GHz (e.g., NR operating band n257) and above.

Here, the term "millimeter wave" generally refers to radio frequencies of 30 gigahertz (GHz) to 300 GHz, where free-space wavelengths range from 10 millimeters (mm) to 1 mm. The term is generally associated with 5G wireless frequencies.

Here, the term "characteristic impedance" generally refers to the ratio of an RF voltage to RF current of a signal travelling along a transmission line or wave guide. The symbol for the characteristic impedance is generally $Z_0$, and is expressed numerically as ohms, where the symbol for ohms is Ω.

Here the term "return loss" generally refers to the loss of power in the signal returned or reflected by a discontinuity in a transmission line or sudden change in characteristic impedance experienced by a travelling wave. This discontinuity can be a mismatch with the terminating load or with a device inserted in the line. It is usually expressed as a ratio in decibels (dB) of incident power to power reflected by the discontinuity. An increasing return loss value indicates higher power transfer, or less power reflected.

Here, the term "circuit" or "module" may refer to one or more passive and/or active components that are arranged to cooperate with one another to provide a desired function. The term "signal" may refer to at least one current signal, voltage signal, magnetic signal, or data/clock signal.

The term "microprocessor" generally refers to an integrated circuit (IC) package comprising a central processing unit (CPU) or microcontroller. The microprocessor package is referred to as a "microprocessor" in this disclosure. A microprocessor socket receives the microprocessor and couples it electrically to a printed circuit board (PCB).

The meaning of "a," "an," and "the" include plural references. The meaning of "in" includes "in" and "on." The vertical orientation is in the z-direction and it is understood that recitations of "top", "bottom", "above" "over" and "below" refer to relative positions in the z-dimension with the usual meaning. Generally, "top", "above", and "over" refer to a superior position on the z-dimension, whereas "bottom", "below" and "under" refer to an inferior position on the z-dimension. The term "on" is used in this disclosure to indicate that one feature or object is in a superior position relative to an inferior feature or object, and in direct contact therewith. However, it is understood that embodiments are not necessarily limited to the orientations or configurations illustrated in the figure.

The terms "substantially," "close," "approximately," "near," and "about," generally refer to being within +/−10% of a target value (unless specifically specified). Unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For the purposes of the present disclosure, phrases "A and/or B" and "A or B" mean (A), (B), or (A and B). For the purposes of the present disclosure, the phrase "A, B, and/or C" means (A), (B), (C), (A and B), (A and C), (B and C), or (A, B and C).

A package or board substrate-integrated broadband launch edge connector is disclosed. The broadband launch edge connector comprises a multi-pin edge connector that may be directly integrated on a printed circuit board or package substrate. The disclosed wideband edge connector may enable board-to-board and board-to-cable interconnection of multiple planar transmission lines designed to carry extremely high frequency (EHF) signals (e.g., signals generally ranging in frequency from 30 gigahertz (GHz) to 100 GHz). Integrated planar transmission lines may be printed circuit strip line transmission lines patterned on a PCB, and flat cables (e.g., flex cable) comprising multiple flat strip transmission lines patterned on a flexible PCB substrate to carry multiple signals in parallel on a single cable. The broadband launch edge connector has a low z-height profile enables transfer of high-speed signals between printed circuit boards with low return loss.

The integrated wideband edge connectors may be formed directly on PCBs and flat multi-conductor cables (e.g., flex cables) by integrated circuit (IC) package build-up techniques, employing build-up layers comprising alternating dielectric and conductive laminate layers. The profile of the disclosed wideband edge connectors has a relatively low profile, enabling use in package-level devices. As an example, the wideband edge connector may be integrated into a stand-alone dedicated high-speed signal PCB module that can be coupled to a separate antenna module, or ancillary circuit module contained on a separate PCB. Alternatively, the wideband edge connector may be incorporated onto a monolithic microwave integrated circuit (MMIC) package, or a break-out board comprising a (MMIC) package.

Views labeled "cross-sectional", "profile", "plan", and "isometric" correspond to orthogonal planes within a cartesian coordinate system. Thus, cross-sectional and profile views are taken in the x-z plane, plan views are taken in the x-y plane, and isometric views are taken in a 3-dimensional cartesian coordinate system (x-y-z). Where appropriate, drawings are labeled with axes to indicate the orientation of the figure.

FIG. 1 illustrates an oblique view of millimeter-wave multi-pin (MWMP) edge connector socket 100 integrated onto the edge of a circuit board, according to some embodiments of the disclosure.

MWMP edge connector socket 100 comprises multiple ground socket pins 101 adjacent to signal socket pins 102 that are embedded in connector housing 103, comprising a dielectric material. In some embodiments, the dielectric material comprises a thermosetting plastic material such as, but not limited to, polyester resins, polyurethanes, phenol-formaldehyde resins, duroplast resins, epoxy resins, epoxy-novolac resins, polyimide resins, bismalemimide resins, cyanate ester resins, furan resins, silicone resins, vinyl ester resins and thiolyte resins. In some embodiments, the dielectric material comprises a thermoplastic material such as, but not limited to, acrylic resins such as poly(methyl methacrylate (PMMA), acrylonitrile butadiene styrene (ABS) resins, polyamide resins (e.g., Nylon), polybenzimdeazole (PBI) resins, polycarbonate resins, polyether sulfone (PES) resins, polyioxymethylene (POM) resins, polyether ether ketone (PEEK) resins, polyetherimide (PEI) resins, polyethylene (PE) resins, polyphenylene oxide (PPO) resins, polyphenylene sulfide (PPS) resins, polypropylene (PP) resins, polystyrene resins, polyvinyl chloride (PVC) resins, polyvinylidene fluoride (PVDF) resins, polytetrafluoroethylene (PTFE) resins and other fluoropolymer resins.

Connector housing 103 is integrated on substrate 104, which may be a printed circuit board (PCB) or a build-up layer substrate such as a bumpless build-up layer (BBUL) package substrate. In some embodiments, substrate 104 comprises multiple signal traces 105 adjacent to multiple ground traces 106 in an alternating arrangement, arranged as a plurality of adjacent parallel planar strip line transmission lines 107 coupled to ground socket pins 101 and signal socket pins 102 of MWMP edge connector socket 100. In some embodiments, traces 105 and 106 are buried within dielectric 108 of substrate 104 as parallel planar stripline transmission lines, where signal traces 105 are coupled to signal socket pins 102 and ground traces 106 are coupled to ground socket pins 101. Ground traces 106 may shield adjacent signal traces 105 from electric fields emanating from neighboring signal traces, suppressing cross-talk. Opposing (and equal) currents in transmission lines (e.g., a signal trace 105 paired with an adjacent ground trace 106) suppress magnetic coupling between adjacent signal traces.

Ground socket pins 101 and signal socket pins 102 each comprise two substantially parallel prongs 109 and 110, respectively, cantilevered from connector housing 103 in they dimension of the figure. Pins 101 and 102 may comprise a conductive material having a sufficient elasticity to permit small amount of bending of cantilevered prongs 109 and 110 at junction 111 to permit insertion of plug pins (e.g., male pins described below and shown in FIG. 2) within receptacles 112 and 113 between prongs 109 and 110, respectively. Conductive materials include metals such as, but are not limited to, copper, copper beryllium alloys and stainless steel alloys.

In some embodiments, ground socket pins 101 have greater dimensions than signal socket pins 102. The larger ground socket pins 101 may electrically shield signal socket pins 102 from stray electric and magnetic fields emanating from neighboring signal pins. As shown in FIG. 1, ground socket pins 102 have a thickness $t_1$ (in the x-dimension) and overall width (in the z-dimension) $w_1$ that are greater than corresponding dimensions $t_2$ and $w_2$ of signal socket pins 102 (e.g., $w_1>w_2$, $t_1>t_2$).

Socket pin pairs comprising ground socket pins 101 and adjacent signal socket pins 102 may function as extensions of transmission lines 107. The socket pin pairs may comprise transmission line segments when equal and opposite currents flow in each pin. As transmission line segments, socket pin pairs exhibit a characteristic impedance. The characteristic impedances of connector pin pairs is a complex function of geometric parameters such as the span s between pins, the thickness $t_1$ and $t_2$, and widths $w_1$ and $w_2$, as well as the dielectric constant of the dielectric material between pins. In some embodiments, the dielectric material is air or a combination of air and the dielectric material of connector housing 103. As an example, dimensions $t_1$ and $w_1$ of ground socket pins 101 may be sized in relation to dimensions $w_2$ and $t_2$ of signal socket pins 102, along with inter-pin distance s between ground socket pins 101 and signal socket pins 102, resulting in a particular characteristic impedance $Z_0$.

Matching the characteristic impedances of the transmission line (e.g., transmission lines 107) and the MWMP edge connector (e.g., MWMP edge connector 400, FIG. 4A) is desirable as signal reflections occur at an impedance discontinuities, causing standing waves of voltage and current to be established along the integrated transmission lines (e.g., transmission lines 107). Increased power losses of signal due to reflected power from the impedance discontinuities and ensuing standing waves along the transmission lines may result. Elimination of reflections at junctions between transmission lines 107 on substrate 104 and MWMP edge connector socket 100 may occur when pairs of ground socket pins 101 and signal socket pins 102 may be extensions of planar transmission lines 107. As such, socket pin pairs are transmission line segments having a characteristic impedance (e.g., impedance $Z_0$). The characteristic impedance of the socket pin pairs may be determined by engineering the geometries of the ground socket pins 101 and adjacent signal socket pins 102 and the span s between them. As an example, socket pin dimensions (e.g., thicknesses $t_1$ and $t_2$, widths $w_1$ and $w_2$) and span s may be engineered to produce a characteristic impedance $Z_0$ of 50 ohms that is matched to a 50 ohm characteristic impedance $Z_1$ of a coupled planar transmission line 107.

As will be described below, the mating plug pin pairs on a separate PCB or cable are similarly engineered to have substantially the same characteristic impedance as the socket (e.g., MWMP edge connector socket 100). When connected, the mated pins of MWMP edge connector socket 100 and plug combination (see FIG. 4A) may form a bridging transmission line segment between separate planar transmission lines (e.g., transmission lines 107 on substrate 104).

As shown in FIG. 1, ground socket pins 101 and signal socket pins 102 extend from MWMP edge connector housing 103. Ground socket pins 101 and signal socket pins 102 have anchoring portions embedded within connector housing 103, and coupling to substrate 104. Details of ground socket pins 101 and signal socket pins 102 are described subsequently, and illustrated in FIGS. 2A-2C, and FIGS. 3A-3C, respectively.

Figure 2A:
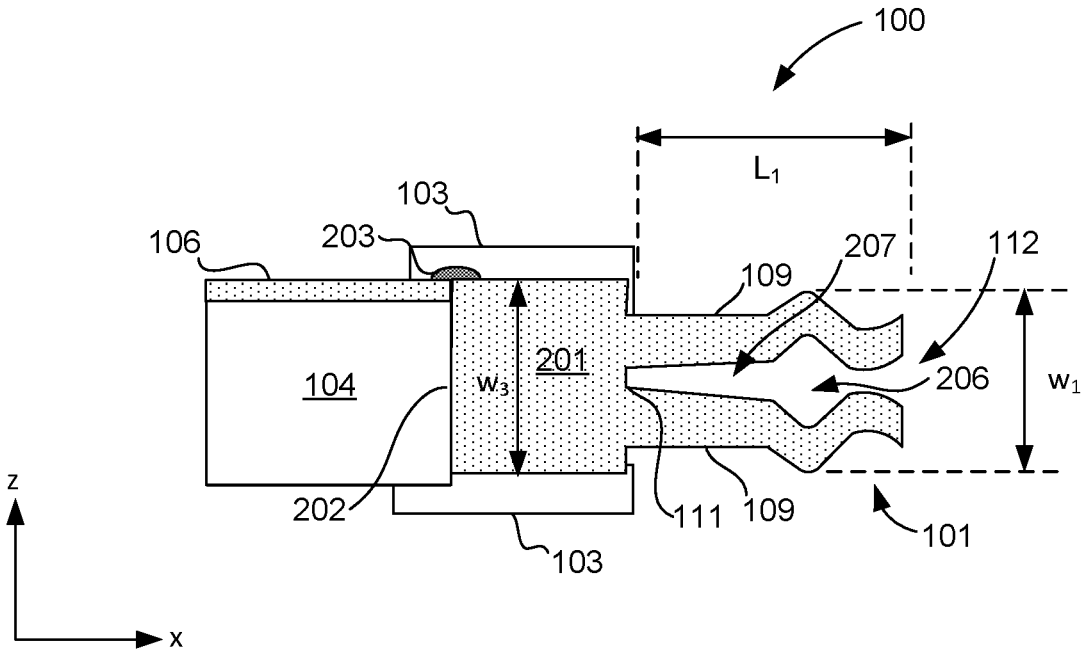
FIG. 2A illustrates a cross-sectional view in the x-z plane of a MWMP edge connector, showing a cross section of a ground socket pin anchored within a connector housing and interfaced with a substrate, according to some embodiments of the disclosure.

FIG. 2A illustrates a cross-sectional view in the x-z plane of MWMP edge connector 100, showing a cross section of ground socket pin 101 anchored within MWMP edge connector housing 103 and interfaced with substrate 104, according to some embodiments of the disclosure.

Figure 2B:
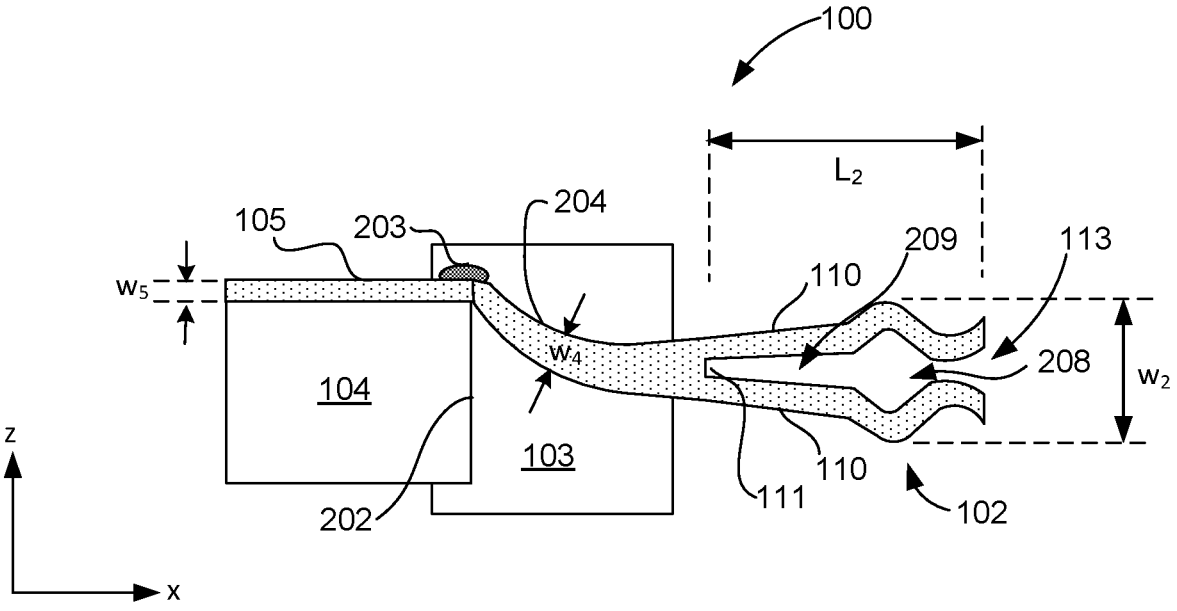
FIG. 2B illustrates a cross-sectional view in the x-z plane of MWMP edge connector, showing a cross-section view of a signal socket pin anchored within the connector housing and interfaced with a substrate, according to some embodiments of the disclosure.

The interior architecture of MWMP edge connector 100 is illustrated by the cross-sectional view through a ground socket pin 101 shown in FIG. 2A, and through a signal socket pin 102 shown in FIG. 2B. Ground socket pin 101 comprises anchor portion 201 congruent with prongs 109. Anchor portion 201 may be embedded within connector housing 103 and abut dielectric 108 of substrate 104. In some embodiments, anchor portion 201 has a rectangular shape to maximize strength and robustness of attachment of socket ground pin 101 to connector housing 103.

In some embodiments, ground trace 106 may extend to PCB edge 202 and be in electrical contact with anchor portion 201. In some embodiments, ground trace 106 may be joined to anchor portion 201 by solder joint 203. Connector housing 103 may be formed as a stand-alone part separate from substrate 104 and press-fit over board edge 202 as a surface mount component. Anchor portion 201 may be soldered-bonded to ground trace 106 by a reflow operation. In some embodiments, MWMP edge connector 100 is integrated directly onto edge 202 of substrate 104 as a package build-up fabrication process described below. In some embodiments, substrate 104 is an integrated circuit (IC) package substrate, where the IC type may include, but is not limited to, a monolithic microwave integrated circuit (MMIC) or a millimeter-wave antenna array module. Metallization between ground traces 106 (and signal traces 105, see FIG. 2B) on substrate 104 and ground socket pin 101 may be integral by formation of traces and pin body simultaneously, as will be described below.

Anchor portion 201 may have a rectangular profile that may comprise the majority of the superficial area of ground socket pin 101, as shown in the illustrated embodiment. The rectangular profile may be characterized by z-height $w_3$. In some embodiments, $w_3$ is equal to or greater than maximal width $w_1$ of expanded portion 206 of prongs 109. In some embodiments, z-height $w_3$ may be adjusted to provide maximal attachment strength of anchor portion 201 to embed within connector housing 103.

FIG. 2B illustrates a cross-sectional view in the x-z plane of MWMP connector 100, showing a cross-section view of a signal socket pin 105 anchored within connector housing 103 and interfaced with substrate 104, according to some embodiments of the disclosure.

FIG. 2B shows interior details of MWMP connector 100 at the level of signal socket pin 102. Anchor portion 204 extends within connector housing 103 from base 111 to edge 202 of substrate 104, and coupling to signal trace 105. Width $w_3$ along anchor portion 204 tapers to a minimum as it extends towards edge 202. In some embodiments, the minimum width $w_4$ is approximately equal to the z-height $t_3$ of signal trace 105. By eliminating abrupt interfaces, a tapered width $w_4$ of anchor portion 204 may enhance the waveguiding properties of signal socket pin 102. Suppression of reflections within anchor portion 204 may increase the return loss of signal socket pin 102.

Signal socket pin 102 may be joined to signal trace 105 by solder joint 203, according to some embodiments. Solder joint 203 may be formed in a solder reflow process, where MWMP edge connector 100 may be a separate standalone component. In some embodiments, MWMP edge connector 100 is integrated onto substrate 104 (at edge 202) as an RF edge connector. In an integrated structure, signal socket pin 102 may be formed integrally with signal trace 105. In some embodiments, anchor portion 204 is bent in the x-z plane of the figure, towards signal trace 105 from a more central position of prong base 111 and prongs 110 along edge 202.

Plug receiving portion 113 between prongs 110 and opens into expanded area 206 for locking a mating signal plug pin to signal socket pin 102, increasing connection robustness. Structural details of signal plug pins are described below. In the illustrated embodiment, expanded area 208 narrows to a tapered elongated space 209 that extends to prong base 111, where it terminates. The elongated space receives an elongated nose (e.g., elongated nose 303, FIG. 3B) of a mating signal plug pin (e.g., signal plug pin 310, FIG. 3B). The elongated mating portions may increase contact area between plug and socket pins, and reduce contact resistance.

Signal socket pin 102 has maximal width $w_2$ that is smaller than width $w_1$ of ground socket pin 101 (FIG. 2A). When assembled into MWMP edge connector socket 100, the larger ground socket pins 101 alternate with the smaller signal socket pins 102, and shield adjacent signal pins from each other. As shown in FIG. 1, ground socket pins 101 are thicker than signal socket pins 102, where the increased ground pin thickness contributes to the shielding of neighboring signal pins.

Figure 3A:
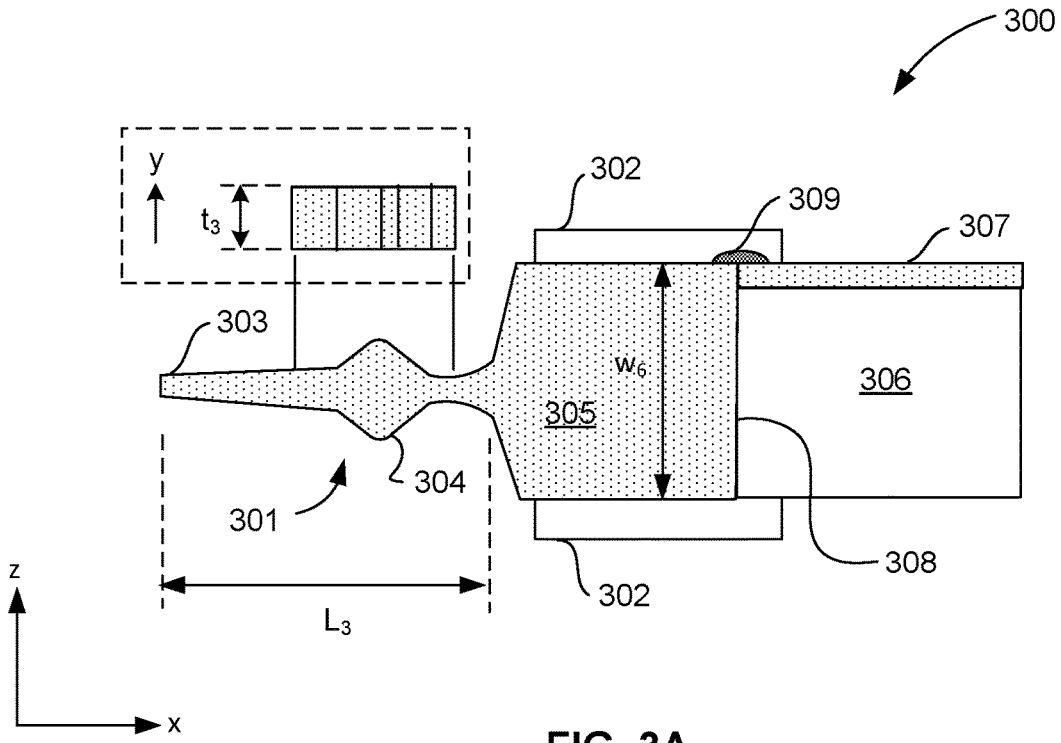
FIG. 3A illustrates a cross-sectional view in the x-z plane of a MWMP edge connector plug, showing internal architecture at the level of a plug ground pin, according to some embodiments of the disclosure.

FIG. 3A illustrates a cross-sectional view in the x-z plane of MWMP edge connector plug 300, showing internal architecture at the level of plug ground pin 301, according to some embodiments of the disclosure.

Figure 3B:
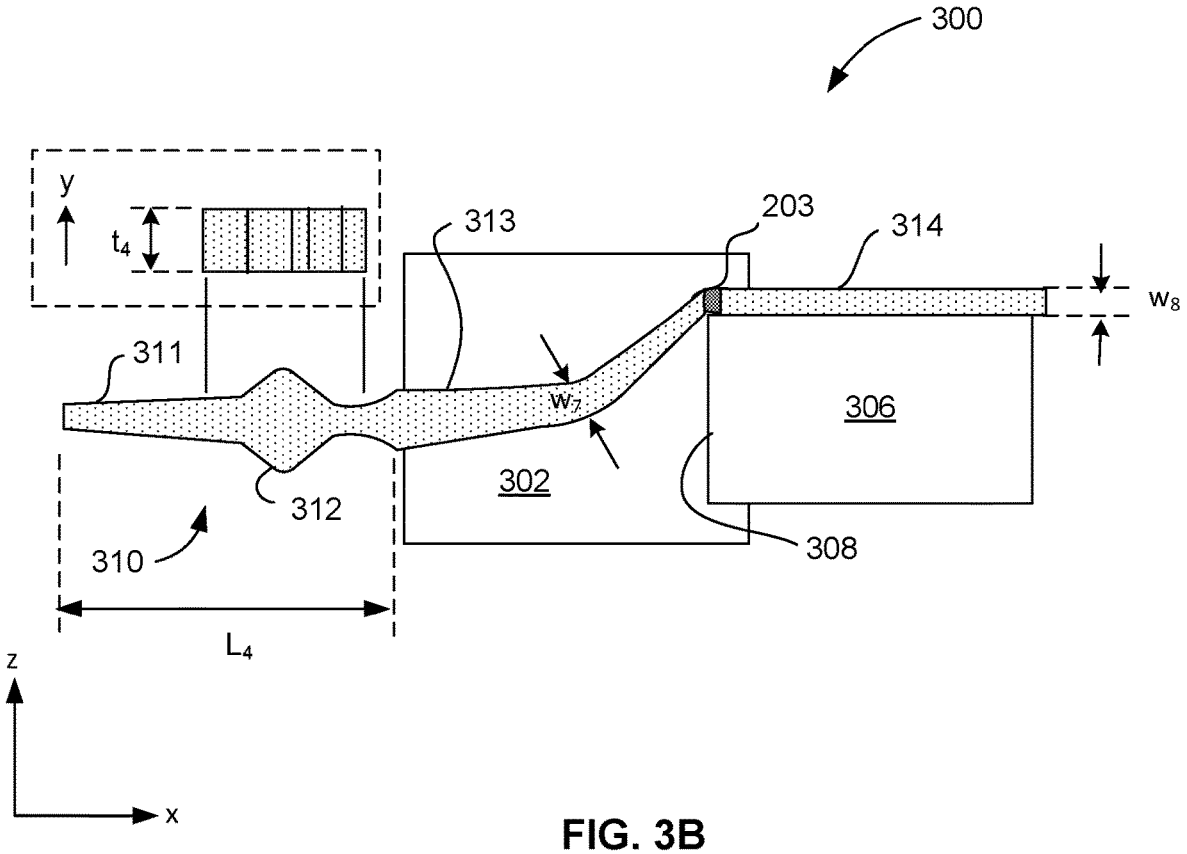
FIG. 3B illustrates a cross-sectional view in the x-z plane of the MWMP edge connector plug of FIG. 3A, showing internal architecture at the level of plug signal pin, according to some embodiments of the disclosure.

MWMP edge connector plug 300 comprises an assembly of plug ground pins 301 and alternating plug signal pins (e.g., plug signal pins 310, FIG. 3B) extending in the y-dimension of the figure (above and below the plane of the figure) within connector housing 302, similar to MWMP edge connector socket 100. The cross-sectional views shown in FIGS. 3A and 3B are understood to be representative of the MWMP edge connector plug architecture, and describe the pin structure that is embedded within the connector housing (e.g., connector housing 302), and normally hidden from view.

Plug ground pin 301 comprises elongated nose 303 and barb 304 corrugation between elongated nose 303 and anchor portion 305. In some embodiments, elongated nose 303 and barb 304 have shapes or corrugations complimentary to elongated space 207 and expanded region 206, respectively, to enable insertion of plug ground pin 301 into socket ground pin 101. Elongated nose 303 may insert into elongated space 207 and barb 304 may insert into expanded portion 206.

In the illustrated embodiment, anchor portion 305 has a rectangular profile to provide the dual function of enhancing the physical strength of the anchor of plug ground pin 301 within connector housing 302, and for providing electromagnetic shielding of adjacent signal pins. It will be understood that other suitable corrugations (e.g., shapes) are possible, such as more complex shapes having notches and/or protrusions to reinforce anchoring strength of plug ground pin 301 within connector housing 302. In some embodiments, ground pins, both for socket or plug portions of the disclosed MWMP edge connector, have larger dimensions than signal pins. Accordingly, ground pins comprise large anchor portions (e.g., anchor portions 201 and 305) than signal pins as forces endured during insertion and disconnection of mating ground pins may be significantly larger than corresponding forces endured by connecting and disconnecting signal pins. The larger anchor portions may provide greater anchoring strength when embedded within connector housing 302.

Anchor portion 305 has a z-height (width) $w_6$. In some embodiments, $w_6$ is approximately equal to z-height $w_3$ of anchor portion 201 (FIG. 2A). Anchor portion 305 extends through connector housing 302 to abut edge 308 of substrate 306 and ground trace 307 on the top surface of substrate 306. In some embodiments, substrate 306 is a flexible RF/millimeter wave flat cable. In some embodiments, substrate 306 is a PCB. In some embodiments, substrate 306 is an IC package substrate. Substrate 306 may be substantially the same as substrate 104 in FIGS. 2A-B. In some embodiments, $w_6$ is at least equal to the z-height of substrate 306, and may extend slightly above substrate 306 to contact ground trace 307. In some embodiments, MWMP edge connector plug 300 is a stand-alone RF edge connector plug that is attached to substrate 306 as a surface-mount component by a solder reflow operation. Anchor portion 305 may be solder-bonded to ground trace 307 through solder joint 309.

Similar to ground socket pins 101, ground plug pin 301 has a corresponding thickness $t_3$ (shown in the top view in the x-y plane in the inset of FIG. 3A). In some embodiments, thickness $t_3$ of ground plug pin 301 is substantially the same as thickness $t_1$ of ground socket pins 101. In some embodiments, thickness $t_3$ is substantially larger than thickness $t_2$ of signal socket pins 102 and thickness $t_4$ of signal plug pins 310 (shown in FIG. 3B). The larger thickness for the ground pin may enhance electromagnetic shielding of adjacent signal pins.

FIG. 3B illustrates a cross-sectional view in the x-z plane of MWMP edge connector plug 300, showing internal architecture at the level of plug signal pin 310, according to some embodiments of the disclosure.

Plug signal pin 310 comprises a forward portion extending outward from connector housing 302 comprising elongated nose 311 and barb 312. Anchor section 313 extends rearward towards substrate 306 through connector housing 302. In some embodiments, anchor section 313 is tapered along its length as it extends towards substrate 306 to match width $w_7$ and the thickness $w_8$ of signal trace 314. Taper of anchor section 313 may reduce return loss, as explained above for signal socket pins 102.

Elongated nose 311 and barb 312 are mating structures for insertion of signal plug pin 310 into signal socket pin 102. In some embodiments, the shapes of elongated nose 311 and barb 312 are complimentary to elongated space 209 and expanded portion 208 of signal socket pin 102 (FIG. 2B). Barb 312 may lock signal plug pin 310 and signal socket pin 101 together when signal plug pin 310 is inserted into signal socket pin 101. Elongated nose 311 may provide a large contact area with signal socket pin 101 to reduce contact resistance.

Figure 4A:
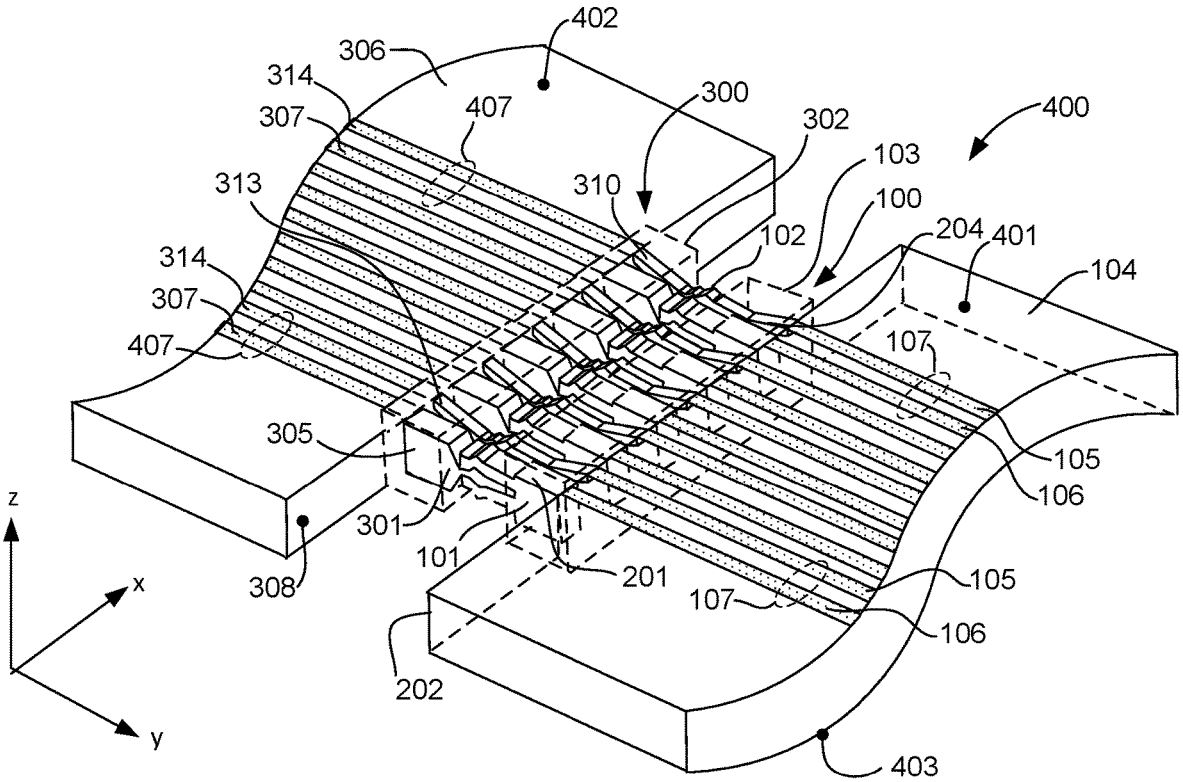
FIG. 4A illustrates an oblique view of a MWMP edge connector assembly comprising a mated MWMP edge connector socket and a MWMP edge connector plug, according to some embodiments of the disclosure.

FIG. 4A illustrates an oblique view of MWMP edge connector assembly 400 comprising mated MWMP connector socket 100 and MWMP edge connector plug 300, according to some embodiments of the disclosure.

FIG. 4A shows assembly of MWMP edge connector 400 as RF edge transmission line connectors coupling multiple transmission line traces 105 and 106 on substrate 104 to transmission line traces 307 and 314 on substrate 306. MWMP edge connector housings 103 and 302 are delineated by hidden lines to expose ground plug pins 301 interlocked with ground socket pins 101 and signal plug pins 310 interlocked with signal socket pins 102. In some embodiments, both of substrates 104 (hidden edges shown) and 306 are printed circuit boards (PCBs) electromagnetically coupled together by MWMP edge connector 400. In some embodiments, both of substrates 104 and 306 are cables (e.g., two flat cables) electromagnetically coupled together by MWMP edge connector 400. In some embodiments, one of substrates 104 and 306 is a PCB and the other one of substrates 104 and 306 is a cable (e.g., a single flat cable) coupled together by MWMP edge connector 400.

In the illustrated embodiment, ground pin anchor sections (e.g., ground socket pin anchor section 201 and ground plug pin anchor section 305) abut edges 202 and 308 of substrates 104 and 206, respectively. In the illustrated embodiment, ground socket pin anchor section 201 and ground plug pin anchor section 305 are planar with upper surfaces 401 of substrate 104 and 402 of substrate 306, respectively (e.g., as shown in FIGS. 2A and 2B). The planarity of the block-shaped anchor sections 201 and 305 with surfaces 401 and 402 enables coupling to ground traces 106 and 307 on substrates 104 and 306, respectively. As shown in the illustrated embodiments of FIGS. 2A and 2B, anchor sections 201 and 305 may be solder bonded to ground traces 106 and 307, respectively. In some embodiments, socket pin anchor sections 201 and 305 are integral with traces 106 and 307, respectively, where MWMP edge connector socket 100 and MWMP edge connector plug 300 are formed by a package build-up process, described below.

In some embodiments, plug pin anchor sections 204 and 313 abut edges 202 and 308, and are curved or bent towards surfaces 401 and 402 (e.g., in the z-direction of the figure as shown in FIGS. 3A and 3B) to meet signal traces 105 and 314, respectively. Pin portions such as pin nose 303 and 311, pin receptacle portions 206 and 208 may be centered between top and bottom surfaces (e.g., midway between surfaces 401 and 403 of substrate 306).

Figure 4B:
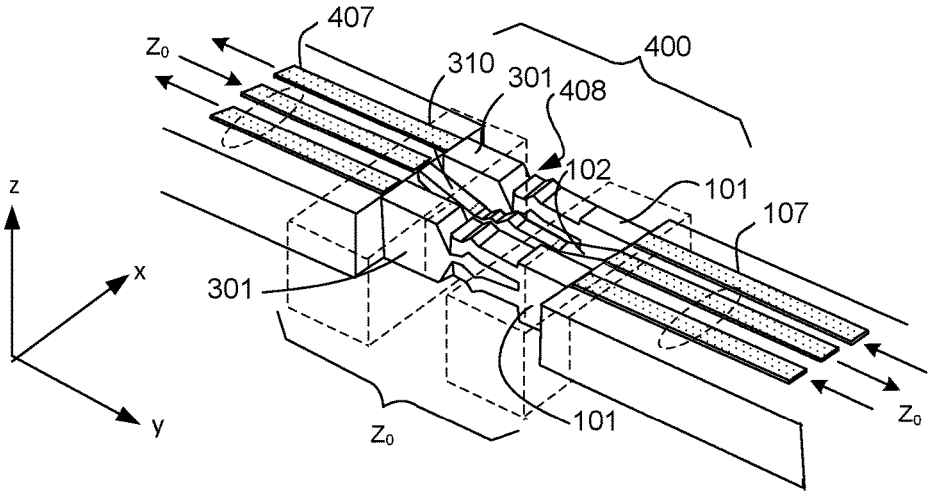
FIG. 4B illustrates an oblique view of an isolated ground and signal pin pair of the MWMP edge connector in FIG. 4A having a characteristic impedance $Z_0$, coupling planar $Z_0$ transmission lines on separate substrates, according to some embodiments of the disclosure.

FIG. 4B illustrates an oblique view of an isolated ground and signal pin pair 408 of MWMP edge connector 400 having a characteristic impedance $Z_0$, coupling planar $Z_0$ transmission lines 107 and 407 on separate substrates 104 and 306, according to some embodiments of the disclosure.

In the illustrated embodiment of FIG. 4B, the isolated section of MWMP edge connector 400 shows the interconnection of planar transmission lines 107 and 407 on separate substrates 104 and 306. Transmission lines 107 and 407 may each have a characteristic impedance $Z_0$. In some embodiments, the section of MWMP edge connector 400 comprises interconnected ground/signal pin pair 408 (comprising interconnected socket/plug ground pin set 101/301 and an adjacent socket/plug signal pin set 102/310) that may behave as a transmission line segment coupling two longer lengths of planar transmission lines 107 and 407.

The characteristic impedance $Z_0$ of interconnected ground/signal pin pair 408 may be tailored to match the $Z_0$ of transmission lines 107 and 407 by engineering the shape, dimensions, spacing and dielectric material surrounding the conductive pins. As an example, interconnected ground/signal pin pair 408 may exhibit a characteristic impedance $Z_0$ equal to approximately 50Ω. Generally, values of $Z_0$ may depend primarily on conductor dimensions, conductor spacing and the dielectric constants of any dielectrics separating conductors. Based on these parameters, $Z_0$ may be calculated by analytical formulas or by finite element computation. $Z_0$ for arbitrary conductor geometries, such as the shape embodiments of the individual pins shown in FIGS. 2A-3B, may be calculated by inputting physical dimensions of pins (e.g., t1, t2, L1-L4, see FIGS. 1-3B), distance s (see FIG. 1) between ground and signal pins and suitable dielectric constants into appropriate impedance formulas.

By behaving as a matching transmission line segment, MWMP edge connector 400 may transfer millimeter-wave signals (indicted by the opposing arrows) between planar transmission line segments 107 and 407 with high return losses (e.g., low signal reflection at the substrate edge and low VSWR along the planar transmission lines).

Figure 4C:
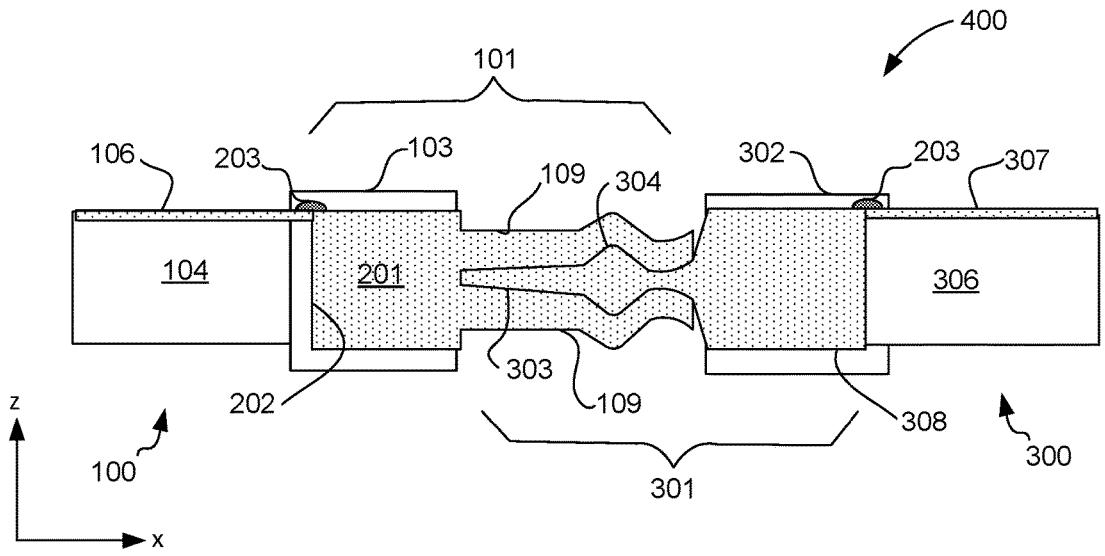
FIG. 4C illustrates a cross-sectional view in the x-z plane of the MWMP edge connector, showing interconnected ground pins, according to some embodiments of the disclosure.

FIG. 4C illustrates a cross-sectional view in the x-z plane of MWMP edge connector 400, showing interconnected ground pins, according to some embodiments of the disclosure.

FIG. 4C shows a cross-section of MWMP edge connector 400, comprising MWMP edge connector socket 100 and plug 300, through a ground-conducting path. Ground pins (e.g., ground socket pin 101 and ground plug pin 301) are shown interconnected across a gap between substrate edges 202 and 308, electrically coupling ground traces 106 on substrate 104 to ground trace 307 on substrate 306. Plug ground pin nose 303 and barb 304 are inserted in the pin receptacle (e.g., pin receptacle 207 and barb receptacle 206) between socket ground pin prongs 109. Anchor portion 201 of ground socket pin 101 is embedded within connector housing 103. The wide block shape of anchor portion 104 may increase the robustness of anchor portion 201 within connector housing 103. According to some embodiments of the disclosure, ground pins (e.g., socket and plug ground pins 101 and 301, respectively) have a more robust construction than signal pins (e.g., socket and plug signal pins 301 and 310, respectively) within MWMP edge connector 400.

The thick construction may require larger forces to connect and disconnect the socket and plug ground pins 101 and 301, respectively, than the thinner signal pins (e.g., socket and plug signal pins 301 and 310, respectively). In addition to barb 304 securing ground plug pin 301 within ground socket pin 101, the square-block shape of anchor portions 201 and 305 may stabilize ground pins 101 and 301 within their respective connector housings 103 and 302 after multiple connection and disconnection cycles.

Figure 4D:
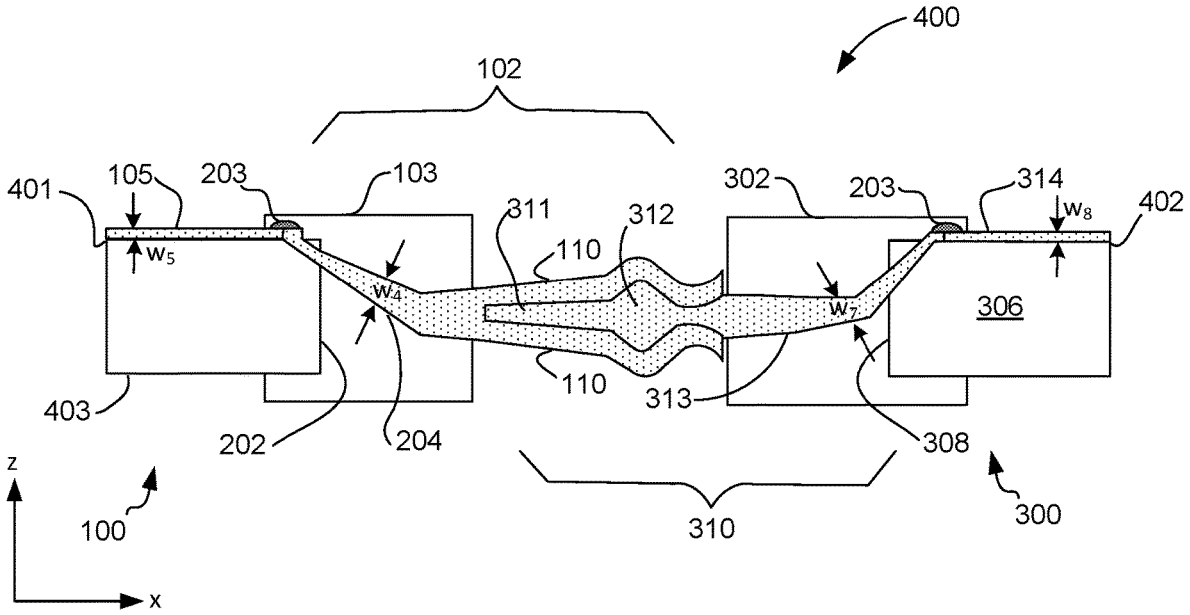
FIG. 4D illustrates a cross-sectional view in the x-z plane of the MWMP edge connector, showing interconnected signal socket and plug pins, according to some embodiments of the disclosure.

FIG. 4D illustrates a cross-sectional view in the x-z plane of MWMP edge connector 400, showing interconnected signal socket and plug pins, according to some embodiments of the disclosure.

FIG. 4D shows a cross-section of MWMP edge connector 400 through a signal conducting path. Signal pins (e.g., signal socket pin 102 and signal plug pin 310) are shown interconnected across a gap between substrate edges 202 and 308, electrically coupling signal traces 105 on substrate 104 to signal trace 314 on substrate 306. Signal plug pin nose 311 is inserted in the pin receptacle of signal socket pin 102 (e.g., pin receptacle 209, FIG. 2B), and barb 312 is within the expanded region barb receptacle of signal socket pin 102 (e.g., expended region 208).

Interconnecting portions of signal pins 301 and 310 may be approximately centered on edges 202 and 308, approximately midway between upper and lower surfaces (e.g., surfaces 401 and 403 on substrate 104, see FIG. 4A). Anchor portion 204 of signal socket pin 301 and anchor portion 313 of signal plug pin 310 are tails extend behind the interconnecting portions, through connector housings 103 and 302, respectively, to edges 202 and 308 of substrates 104 and 306. In some embodiments, anchor portions 204 and 313 have a curvature or bend (in the x-z plane of the figure) toward surfaces 401 and 402 or substrates 104 and 306, respectively. The curvature or bend in the tapered anchor portion enables joining of signal pins 102 and 310 to signal traces 105 and 314, respectively. In some embodiments, anchor portions 204 and 313 are substantially straight. As an example, the interconnected portions of the signal pins may be positioned near or at the level of substrate surfaces 401 and 402. Anchor portions 204 and 313 may extend horizontally (e.g., along the x-dimension) to join signal traces 105 and 314.

In some embodiments, widths $w_4$ and $w_7$ of anchor portions 204 and 313, respectively, are reductively tapered to a value that is approximately the thickness of signal traces (e.g., thicknesses $w_5$ and $w_8$). The gradual reduction of widths $w_4$ and $w_7$ to substantially equal the thicknesses $w_5$ and $w_8$ of signal traces 105 and 313 may reduce signal reflections and increase return losses of signals at the boundary of signal pins 102 and 310 and signal traces 105 and 314, respectively. In some embodiments, anchor portions 204 and 313 are joined to signal traces 105 and 314 by solder joints 203. In some embodiments, anchor portions 204 and 313 are integral with signal traces 105 and 314. As an example, MWMP edge connector socket 100 and MWMP edge connector plug 300 may be formed as part of an IC package substrate (not shown). A package build-up process, where anchor portions 204 and 313 may be formed with signal traces 105 and 314 in a metallization process such as an electroplating process (described below).

In some embodiments, signal socket pin 301 comprises a spring metal (e.g., a copper-beryllium alloy) having a high elastic modulus and able to undergo elastic deformation during insertion of signal plug pin 310 into signal socket pin 102. Prongs 110 may be elastically flexed apart as plug pin nose 311 and barb 312 passes through receiving portion of signal socket pin 301 (e.g., receiving portion 113 FIG. 2B). Prongs 110 may clamp over plug pin nose 311 and barb 312 once barb 312 is seated within expanded region (e.g., expanded region 208, FIG. 2B), securely binding signal plug pin 310 to signal socket pin 301.

Figure 5A:
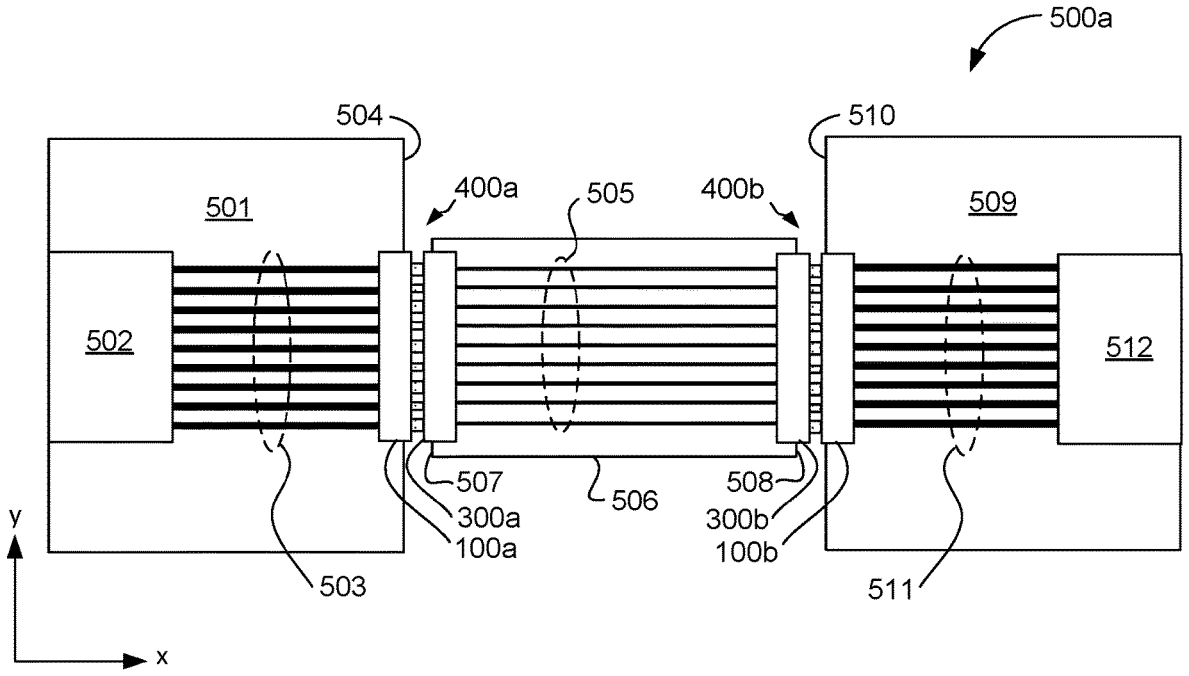
FIG. 5A illustrates a plan view in the x-y plane of board-to-cable implementation of the MWMP edge connector assembly of FIG. 4A, according to some embodiments of the disclosure.

FIG. 5A illustrates a plan view in the x-y plane of board-to-cable implementation 500*a* of MWMP edge connector assembly 400, according to some embodiments of the disclosure.

In the illustrated embodiment, PCB 501 may comprise one or more millimeter wave sources 502, such as, but not limited to, a digital synthesizer to generate millimeter-wave RF voltages (e.g., 30 GHz to 300 GHz) or a MMIC for outputting digitally-modulated and amplified millimeter-wave RF power. In some embodiments, source 502 is coupled to multiple strip-line transmission line traces 503 that run on the surface of PCB 501 to MWMP edge connector assembly 400*a*. In some embodiments, traces 503 and/or 511 are embedded, or on the inner layers of PCB 501. MWMP edge connector assembly 400*a* comprises MWMP connector socket 100*a* permanently affixed on edge 504 of PCB 501 and terminates multiple strip-line (or otherwise planar) transmission line traces 503. In some embodiments, MWMP connector plug 300*a* is mounted on edge 504.

In some embodiments, MWMP connector plug 300*a* terminates conductors 505 distributed on or within the carrier dielectric of cable 506, where MWMP connector plug 300*a* is coupled to end 507 of cable 506. In some embodiments, cable 506 is a flexible flat cable (e.g., FPC or flex cable), comprising planar parallel conductor traces carried on a flexible thin organic dielectric sheet (e.g., a thin flexible sheet of dielectric material comprising polyester, polyimide or PEEK). In some embodiments, cable 506 is a ribbon cable, comprising multiple parallel stranded or solid round wires embedded in a flexible polymeric insulation (e.g., polyvinyl chloride PVC, perfluoro- and polyfluorohydrocarbons). Widths or diameters of conductors 505, spacing between individual conductors 505 and inter-conductor insulation dielectric constant may be varied to produce a range of characteristic impedance $Z_0$ (e.g., 50Ω) between any pair of conductors 505 than may form a planar transmission line.

MWMP connector plug 300*a* carries plug ground and signal pins (e.g., plug ground and signal pins 102 and 310, respectively) that mate to socket ground and signal pins (e.g., socket ground and signal pins 101 and 310, respectively). MWMP edge connector assembly 400*a* couples conductors 505 on cable 506 to transmission line traces 503 on PCB 501.

In the illustrated embodiment, cable 506 is terminated at end 508 (opposite end 507) by a second MWMP connector plug 300*b*. Cable 506 is connected to PCB 509 through second MWMP edge connector assembly 400*b*, comprising MWMP connector socket 100*b* on PCB edge 510, mated to MWMP connector plug 300*b*. PCB 509 may be a physically separate board, but is electrically coupled to PCB 501 through cable 506. PCB 509 comprises multiple strip-line (or otherwise planar) transmission line traces 511 extending from PCB edge 510 to one or more millimeter-wave RF loads or receivers 512. MWMP connector socket 100*b* is electrically coupled to transmission line traces 511, terminating transmission line traces 511 at edge 510.

In some embodiments, loads 512 comprise devices such as, but not limited to, a millimeter-wave antenna array, a multiplexer, a microprocessor, a logic array, an analog MMIC amplifier or a mixer. According to some embodiments, both sets of transmission line traces 503 and 511 (e.g., strip-line traces) have a characteristic impedance $Z_0$ (e.g., 50Ω), and are terminated by matched-impedance (e.g., having approximately the same value of $Z_0$) MWMP edge connector assemblies 400*a* and 400*b* for maximum return losses between source(s) 502 and load(s) 512. In implementation 500, MWMP edge connector assemblies 400*a* and 400*b* may behave as matched transmission line segments having a $Z_0$ value substantially the same as that for planar transmission lines 502 and 513 on PCBs 501 and 509. As an example, $Z_0$ values of MWMP edge connector assemblies 400*a* and 400*b* may be substantially 50Ω. It is understood that other suitable values of $Z_0$ (e.g., 75 Ω, 300Ω) may be employed as a system characteristic impedance, depending on demands of the implementation.

Figure 5B:
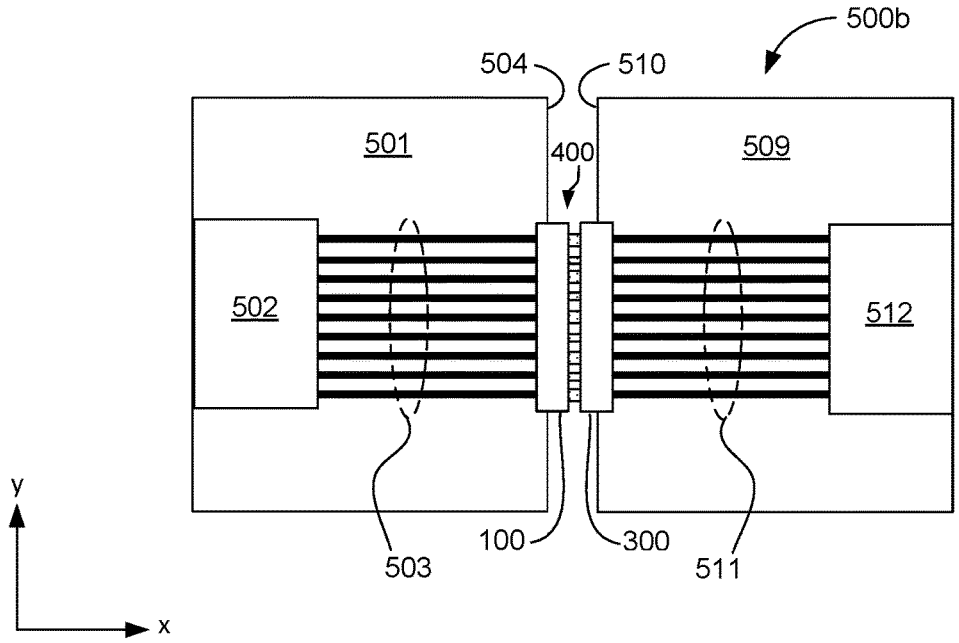
FIG. 5B illustrates a plan view in the x-y plane of a board-to-board implementation of the MWMP edge connector assembly of FIG. 4A, according to some embodiments of the disclosure.

FIG. 5B illustrates a plan view in the x-y plane of board-to-board implementation 500*b* of MWMP edge connector assembly 400, according to some embodiments of the disclosure.

In the implementation shown in FIG. 5B, PCB 501 is directly interconnected to PCB 509 through a single MWMP edge connector 400. In the illustrated embodiment, MPMP edge connector socket 100 is on edge 504 of PCB 501 and interconnected with MWMP edge connector plug 300 on edge 510 of PCB 509. MWMP edge connector socket 100 terminates traces 503 coupled to millimeter-wave RF source 502. In some embodiments, traces 503 comprise multiple planar transmission lines (e.g., microstrip lines). Millimeter-wave RF source 502 has been described above.

One or more millimeter-wave RF signals originating from source(s) 502 may be launched from MWMP edge connector socket 100 and carried through transmission line-like MWMP edge connector 400 to traces 511 leading load(s) 512. In some embodiments, traces 511 comprise multiple planar transmission lines. MWMP edge connector 400 may couple both sets of transmission lines on PCBs 501 and 509 with matched impedances $Z_0$. In some fixed-frequency embodiments, the transmission line characteristic impedance $Z_1$ of transmission lines on PCB 501 and transmission line characteristic impedance $Z_2$ on PCB 509 are different.

In some embodiments, the conduction path MWMP edge connector 400 may have a length equivalent to a quarter-wavelength of the signal frequency, or odd multiples thereof (e.g., a Q-section). As an example, for a 30 GHz signal frequency, the wavelength is approximately 10 cm (assuming a velocity factor near unity). MWMP edge connector 400 have a span of approximately 2.5 cm from edge to edge, and may function as a quarter wave Q-section transmission line to transform $Z_1$ to $Z_2$. As a Q-section transmission line transformer, the characteristic impedance $Z_0$ of MWMP edge connector 400 is approximately equal to $\sqrt{(Z_1 \times Z_2)}$. For off-resonant lengths, other suitable impedance values may be obtained for $Z_0$ of MWMP edge connector 400 to transform $Z_1$ to $Z_2$.

FIGS. 6A-6F illustrate a profile view in the y-z plane of MWMP edge connector plugs and sockets, showing variations of pin orientation, according to some embodiments of the disclosure.

Figure 6A:
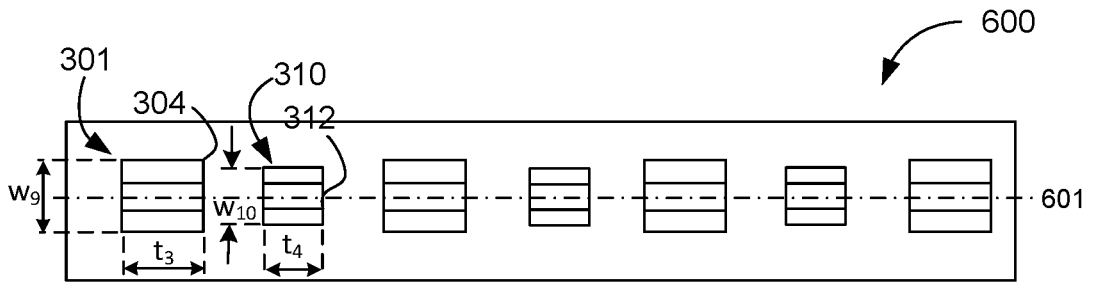
FIGS. 6A-6F illustrate a profile view in the y-z plane of MWMP edge connector plugs and sockets, showing variations of pin orientation, according to some embodiments of the disclosure.

FIG. 6A shows MWMP edge connector plug 600 comprising ground plug pins 301 and signal plug pins 310 in an end-on view, represented schematically as outlines. In the illustrated embodiment, ground plug pins 301 and signal plug pins 310 are in the same orientation as shown in FIGS. 1 to 5B. Maximum thicknesses $t_3$ of ground socket pin 301 and $t_4$ of signal socket pin 310 are oriented along the x-dimension. In some embodiments, thicknesses $t_3$ and $t_4$ are uniform along pins 301 and 310. Maximum widths $w_9$ and $w_{10}$ are taken at barbs 304 and 312. Maximum widths $w_9$ and $w_{10}$ (e.g., the widths of barbs 304 and 312) extend vertically (e.g., in the z-dimension). Centerline 601 indicates a reference plane that is aligned with the centerline of mating edge connector socket (described below).

Figure 6B:
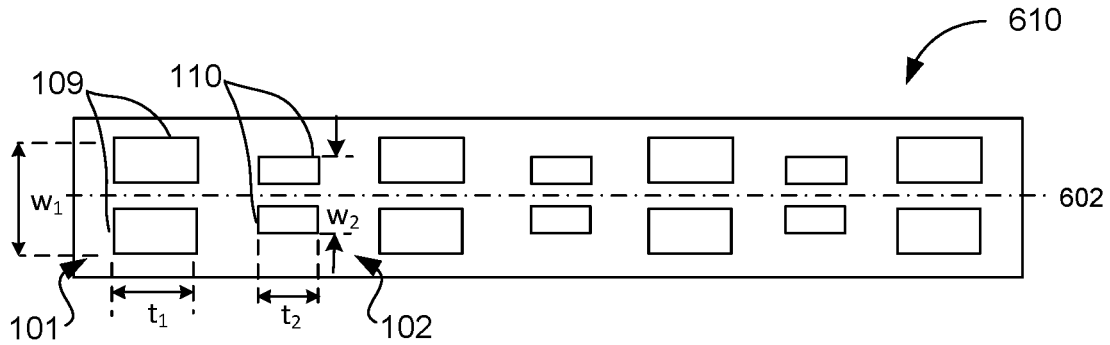

FIG. 6B shows MWMP edge connector socket 610, complimentary to MWMP edge connector plug 610. MWMP edge connector socket 630 comprises ground socket pins 101 and adjacent signal socket pins 102, prongs 109 and 110 are in the same orientation as shown in FIGS. 1 to 5B to receive plug pins. In the illustrated embodiment, thicknesses $t_1$ and $t_2$ (as shown in FIG. 1) of ground socket pins 101 and signal socket pins 102, respectively, are oriented in the x-dimension. MWMP edge connector socket 610 may be mated with MWMP edge connector plug 600 (FIG. 6A). Centerline 602 indicates a reference plane that is aligned with centerline 601 for optimal alignment of signal and ground socket pins with corresponding plug pins, where ground pins electrically shield signal pins.

Figure 6C:
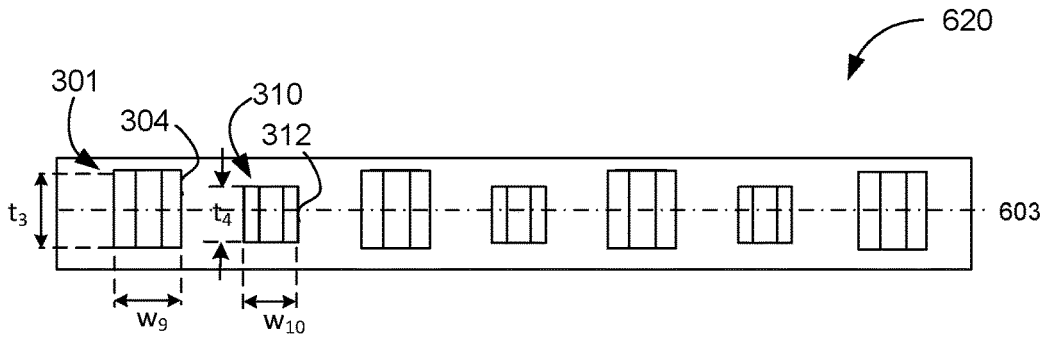

FIG. 6C shows MWMP edge connector plug 620 comprising ground plug pins 301 and signal plug pins 310 in an end-on view, represented schematically as outlines. In the illustrated embodiment, ground plug pins 301 and signal plug pins 310 is rotated 90° with respect to the pin orientations shown in FIGS. 1 to 5B. Maximum thicknesses $t_3$ of ground socket pin 301 and $t_4$ of signal socket pin 310 are oriented along the z-dimension (opposed to the orientation in the x-dimension as described above). In some embodiments, thicknesses $t_3$ and $t_4$ are uniform along pins 301 and 310. Maximum widths $w_9$ and $w_{10}$ are taken at barbs 304 and 312. Maximum widths $w_9$ and $w_{10}$ (e.g., the widths of barbs 304 and 312) extend horizontally (e.g., in the x-dimension). Centerline 603 indicates a reference plane that is aligned with the centerline of mating edge connector socket (e.g., centerline 604 in FIG. 6D).

Figure 6D:
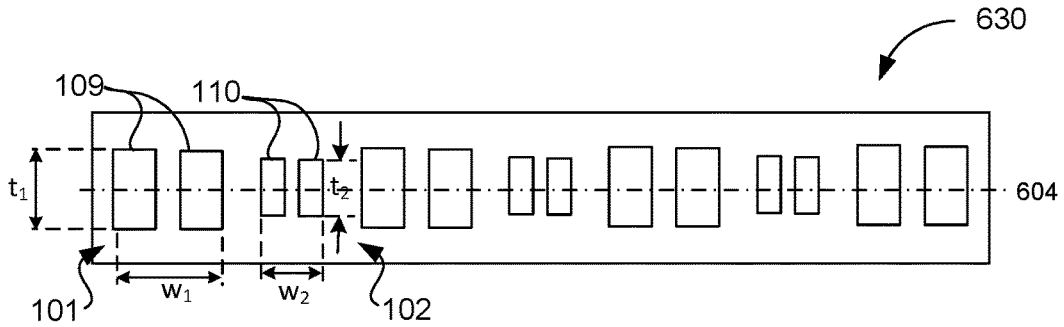

FIG. 6D shows MWMP edge connector socket 630, complimentary to MWMP edge connector plug 620. MWMP edge connector socket 630 comprises ground socket pins 101 and adjacent signal socket pins 102, prongs 109 and 110 are rotated 90° with respect to the socket pin orientation shown in FIGS. 1 to 5B to receive plug pins. In the illustrated embodiment, thicknesses $t_1$ and $t_2$ (as shown in FIG. 1) of ground socket pins 101 and signal socket pins 102, respectively, are oriented in the z-dimension. MWMP edge connector socket 630 may be mated with MWMP edge connector plug 620 (FIG. 6C). Centerline 604 indicates a reference plane that is aligned with centerline 603 (FIG. 6C) for optimal alignment of signal and ground socket pins with corresponding plug pins, where ground pins electrically shield signal pins.

Figure 6E:
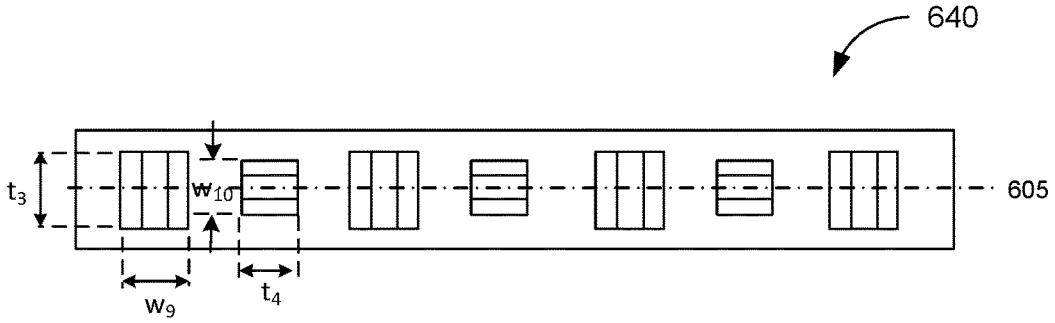

FIG. 6E shows MWMP edge connector plug 640 comprising ground plug pins 301 and signal plug pins 310 having orthogonal orientations with respect to each other. In the illustrated embodiment, thickness $t_4$ of plug signal pin 310 is rotated 90° from thickness $t_3$ of plug ground pin 301. Centerline 605 indicates a reference plane that is aligned with the centerline of mating edge connector socket (e.g., centerline 606 in FIG. 6F).

Figure 6F:
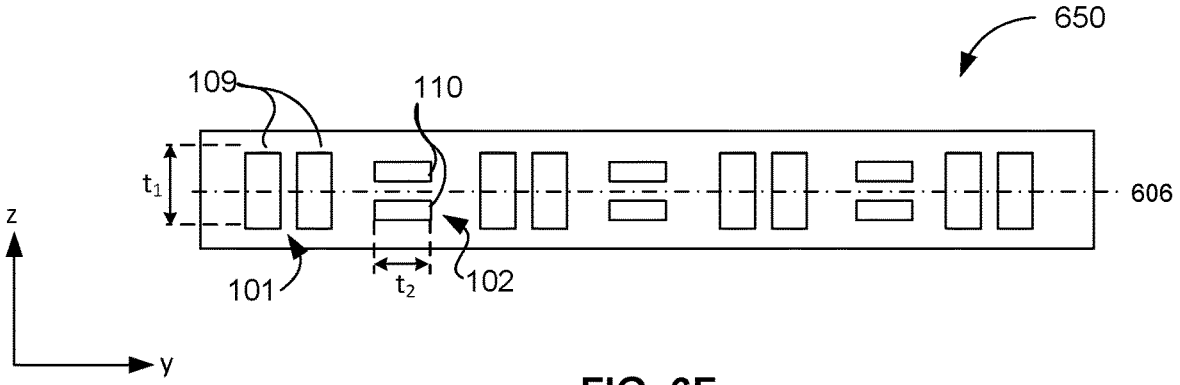

FIG. 6F shows MWMP edge connector socket 650 complimentary to MWMP edge connector plug 620. MWMP edge connector socket 630 comprises ground socket pins 101 and orthogonally-oriented signal socket pins 102, having orientations complimentary to ground plug pins 301 and signal plug pins 310. MWMP edge connector socket 650 may be mated with MWMP edge connector plug 640 (FIG. 6E). Centerline 606 indicates a reference plane that is aligned with centerline 605 in FIG. 6E for optimal alignment of signal and ground socket pins with corresponding plug pins, where ground pins electrically shield signal pins.

In some embodiments, both the socket and plug pins are in planar form integrated on printed circuit boards.

Figure 7A:
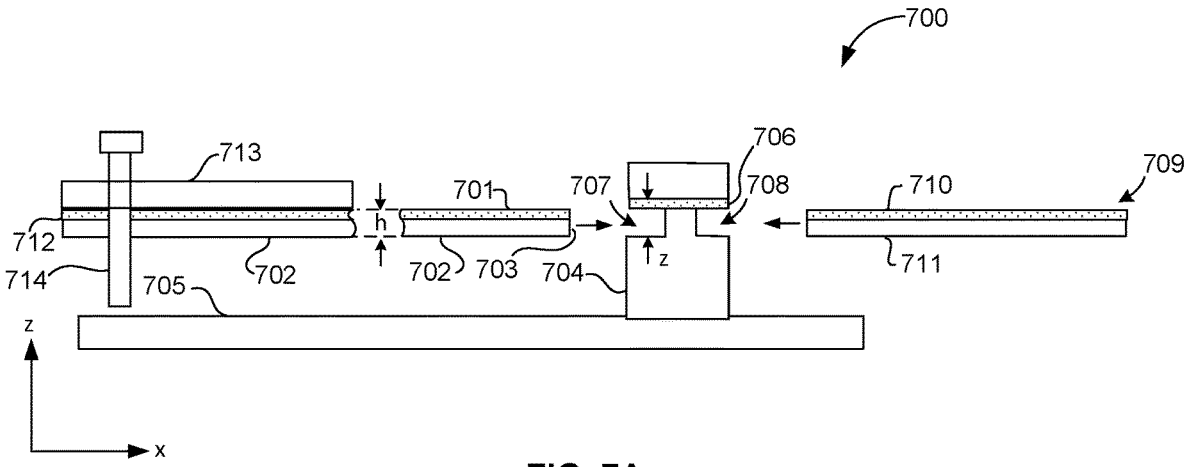
FIG. 7A illustrates a cross-sectional view in the x-z plane of an integrated MWMP edge connector comprising board-integrated pins and cable receptacle, according to some embodiments of the disclosure.

FIG. 7A illustrates a cross-sectional view in the x-z plane of MWMP edge connector 700, comprising board-integrated pins and cable receptacle, according to some embodiments of the disclosure.

MWMP edge connector 700 comprises plug pins 701 integrated on a substrate 702 (near edge 703) and receptacle (socket) 704 attached to PCB 705. Receptacle 704 comprises mating contacts 705 that interface with plug pins 701. Mating contacts 706 are adjacent to recess 707, where recess 707 receives substrate 702. In some embodiments, recess 707 has an aperture z that is approximately the thickness h of substrate 702, including the thickness of plug pins 701. In some embodiments, substrate 702 may slide into recess 707, interfacing mating contacts 706 to plug pins 701.

In some embodiments, receptacle 703 comprises cable docking port 708 to receive cable 709. In some embodiments, cable 709 is a flexible flat cable (e.g., flex cable). Cable 709 comprises flat conductors 710 carried on dielectric sheet 711. A description of cable 709 as a flex cable is given above. Receptacle 704 may be fastened to PCB 705 by a bolt or screw (not shown). PCB 705 may be a computer motherboard, or a specialized printed circuit board such as an antenna module in a mobile device.

Plug pins 701 may terminate traces 712 at edge 703 of substrate 702. Pairs of traces 712 may have dimensions and inter-conductor spacing to form transmission lines having a characteristic impedance $Z_0$. As an example, a trace width, thickness and inter-conductor spacing may be selected to yield a $Z_0$ of approximately 50Ω. Other values of $Z_0$, such as 75Ω, are also possible by selecting other dimensions. Mating contacts 706 extend between plug pins 701 and flat conductors 710 on cable 709 when inserted into cable docking port 708. In some embodiments, plug pins 701 are paired as transmission line extensions of planar transmission lines. When mated to mating contacts 706, the assembly MWMP edge connector 700 has a characteristic impedance $Z_0$ (e.g., $Z_0$=50Ω), matching $Z_0$ of plug pins 701. In some embodiments, pairs of adjacent flat conductors 710 on cable 709 may form transmission lines with a characteristic impedance $Z_2$. Mating contacts may extend over flat conductors 710 and couple traces 712 to flat conductors 710.

In some embodiments, substrate 702 is an IC package substrate supporting one or more mounted IC dies (not shown). In some embodiments, substrate 702 is a PCB supporting an IC package (not shown). In some embodiments, overmold 713 covers a portion of substrate 702 and may pot one or more IC dies supported on substrate 702. Overmold 713 may comprise an epoxy resin or an epoxy-ceramic composite. In some embodiments, mounting screw 714 extends through substrate 702 (in some embodiments, also through overmold 713). Mounting screw 714 may be employed to secure substrate 702 to PCB 705.

Figure 7B:
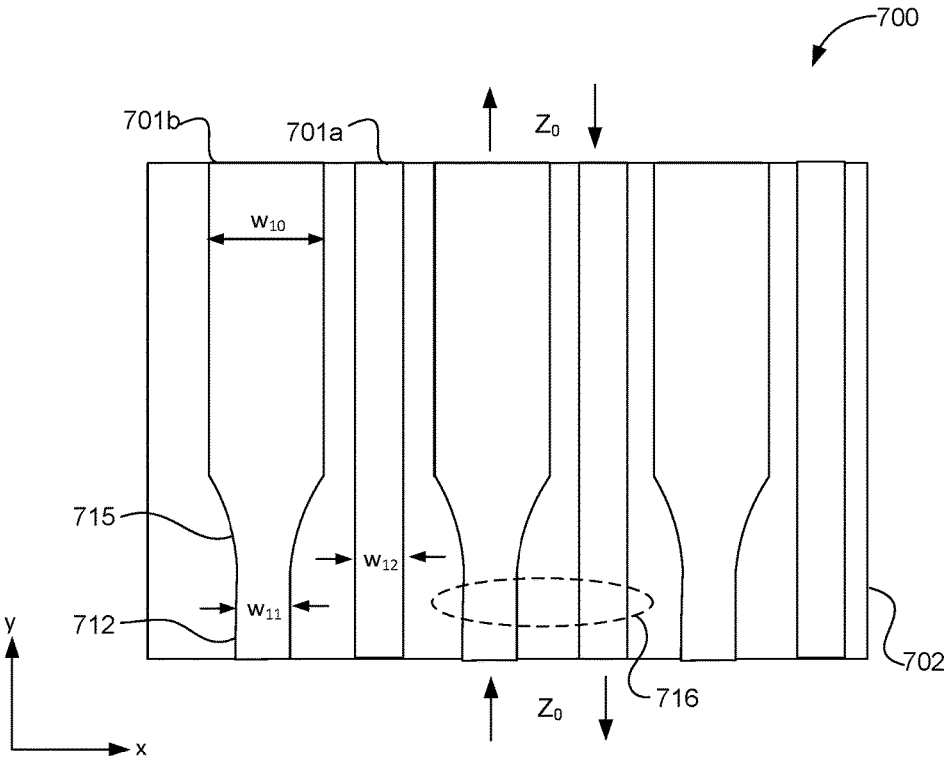
FIG. 7B illustrates a plan view of planar plug pins of an integrated MWMP edge connector, according to some embodiments of the disclosure.

FIG. 7B illustrates a plan view of planar plug pins 701 of integrated MWMP edge connector 700, according to some embodiments of the disclosure.

FIG. 7B shows planar signal plug pins as extensions of trace conductors 712. Planar plug pins 701 are segregated into signal plug pins 701*a* and ground plug pins 701*b* (collectively referred to as planar plug pins 701) as integral components on substrate 702. Ground plug pins 701*b* may have a width $w_{10}$. In some embodiments, transitional coupling regions 715 have a tapered width that transitions from the width $w_{11}$ of ground trace conductors 712 to width $w_{10}$ ($w_{10}>w_{11}$) of ground plug pins 701*b*. The larger width $w_{10}$ of ground plug pins 701*b* relative to width $w_{12}$ of adjacent signal plug pins 701*a* may increase separation between signal plug pins and increase shielding of signal plug pins from electromagnetic coupling from other signal plug pins 701*a*. In some embodiments, width $w_{10}$ is substantially equal to width $w_{11}$. In general, dimensions may be chosen to match impedances between trace conductors 712 and planar plug pins 701.

Pairs of adjacent trace conductors 712 may be combined as transmission lines 716 having a characteristic impedance $Z_0$ for conveying millimeter-wave signals, indicated by the upward and downward pointing arrows in the figure, terminating at ground plug pins 701*b* and signal plug pins 701*a*. In some embodiments, transmission lines 716 have a characteristic impedance $Z_2$ that is different from $Z_0$ (e.g., $Z_0$=50Ω and $Z_2$=300Ω). The curvature of coupling regions 715 may enable a gradual transition of characteristic impedance $Z_2$ to a characteristic impedance $Z_0$ of MWMP edge connector 700 if $Z_2$ is different from $Z_0$.

Figure 8A:
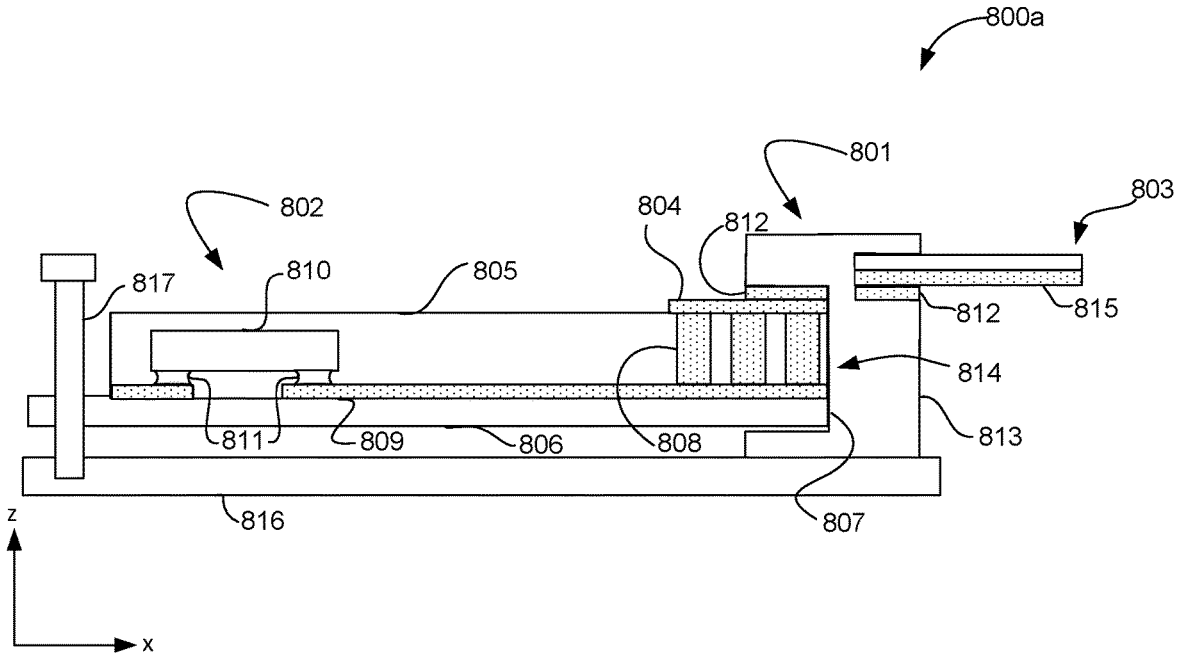
FIG. 8A illustrates a cross-sectional view in the x-z plane of a device assembly comprising a MWMP edge connector partially integrated on a device coupled to the MWMP edge connector, according to some embodiments of the disclosure.

FIG. 8A illustrates a cross-sectional view in the x-z plane of device assembly 800*a*, comprising MWMP edge connector 801 partially integrated on device 802 coupled to MWMP edge connector 801, according to some embodiments of the disclosure.

In FIG. 8A, device 802 is coupled to cable 803 through MWMP edge connector 801, comprising plug pins 804 integrated on device 802. In the illustrated embodiment, plug pins 804 are integrated on the top surface of overmold 805, covering substrate 806 to edge 807. Plug pins 804 are planar pins that may be formed on overmold 805 by an electrodeposition process. Vias 808 extend vertically through overmold 805 from plug pins 804 to embedded trace conductors 809 and/or other metallization structures on substrate 806.

In some embodiments, device 802 is an IC package comprising IC die 810. As an example, IC die 810 may be a monolithic microwave integrated circuit (MMIC). Device 802 may be surface-mounted on substrate 806, and coupled to conductor traces 809 through solder joints 811. Vias 808 transfer signals from IC die 810 to plug pins 804, which is mated to mating contacts 812 on receptacle 813. Device 802 is inserted in device docking port 814, interfacing plug pins 804 to mating contacts 812. Mating contacts 812 extend through receptacle 813 to interface with flat conductors 815 on cable 803. Receptacle 813 may be mounted on platform 816. In some embodiments, platform 816 is a PCB, such as a motherboard of a mobile computing device. In some embodiments, platform 816 is part of a mobile device enclosure. In some embodiments, assembly screw 817 extends through substrate 806 to platform 815, and may be employed to secure device 802 to platform 816 and immobilize it within docking port 814.

Figure 8B:
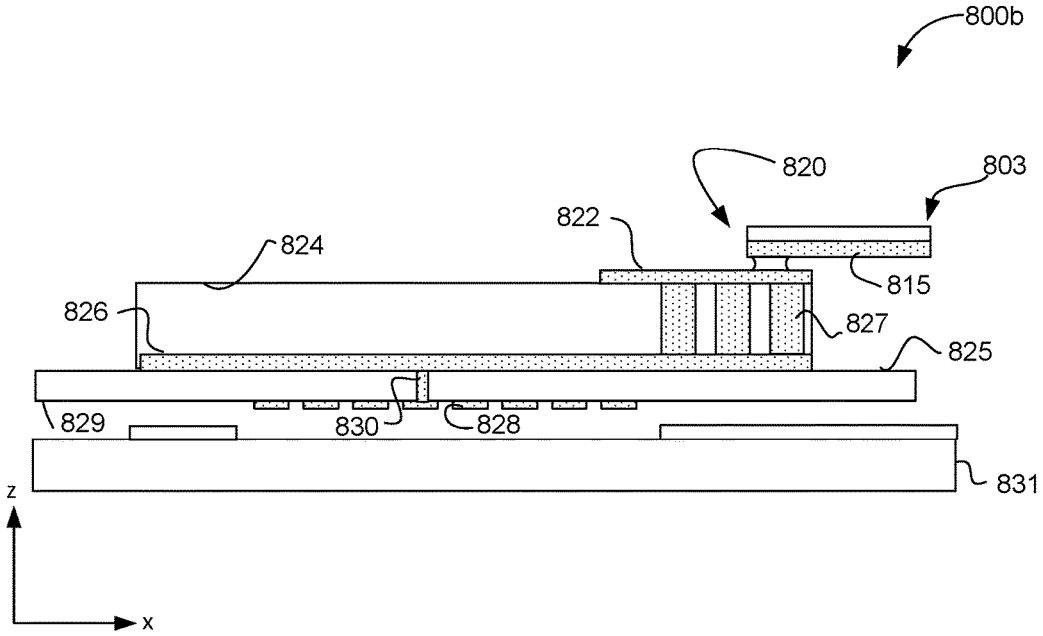
FIG. 8B illustrates a cross-sectional view in the x-z plane of a device assembly comprising a MWMP edge connector integrated on a device, comprising a patch antenna array, according to some embodiments of the disclosure.

FIG. 8B illustrates a cross-sectional view in the x-z plane of device assembly 800*b*, comprising MWMP edge connector 800*b* integrated on device 820, comprising a patch antenna array, according to some embodiments of the disclosure.

In FIG. 8B, MWMP edge connector comprises planar pins 822 integrated on overmold 823 on device 820. In some embodiments, planar pins 822 are solder-bonded to trace conductors 815 on cable 803 through solder joints 824. In some embodiments, device 820 is an antenna in package (AIP) module. Metallization structures on substrate 825, such as trace routing 826, are coupled to planar pins 822 though vias 827. Patch antenna array 828 is integrated on bottom surface 829 of substrate 825, and coupled to trace routing 826 by via 830. Patch antenna array 828 may be a phased antenna array for steering directivity of the transmitted and received wireless signals.

In some embodiments, device assembly 800*b* is an antenna array for transmission and reception of frequencies above 30 GHz. Device assembly 800*b* may be part of a mobile phone or other mobile device enabled for wireless communication in a 5G network. Patch antenna array 828 may be adjacent to partition 831, which may be part of a mobile device enclosure. Partition 831 may comprise materials that are have a low absorptivity (high transmissivity) of rf energy in the millimeter-wave range (e.g., 30 to 100 GHz), and act as a transparent window in this frequency range for launching the if energy out of the device, and for passing rf energy from the exterior of the device to patch antenna array 828 within the device.

Figure 9:
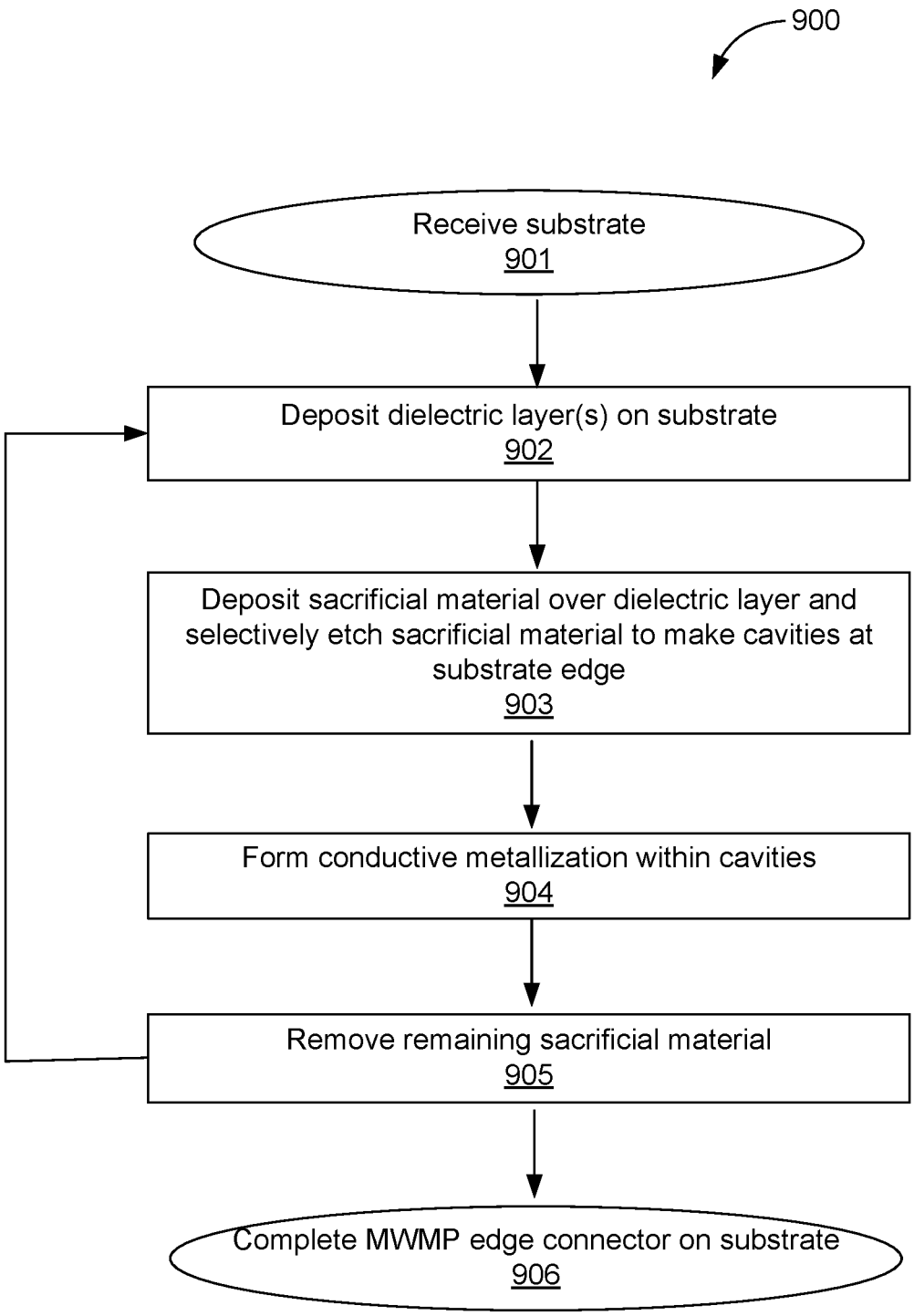
FIG. 9 illustrates a process flow chart for making a MWMP edge connector, according to some embodiments of the disclosure.

FIG. 9 illustrates process flow chart 900 for making a MWMP edge connector, according to some embodiments of the disclosure.

At operation 901, a substrate (e.g., substrate 806 in FIG. 8A) is received as a printed circuit board or an IC package substrate. In some embodiments, the substrate is formed by a build-up layer process, such as, but not limited to, a bumpless build-up layer (BBUL) process for formation of IC package substrates, in which dielectric layers are overlaid as laminates, and patterned to form conductive layers (generally by electrodeposition of copper) between or within dielectric layers.

In some embodiments, the substrate is a PCB comprising strip-line and/or microstrip traces as planar transmission lines for conveying millimeter-wave signals to the board edge, and between devices mounted on the board. In some embodiments, the PCB is part of an IC package.

At operation 902, dielectric is formed over the substrate in layers. In some embodiments, the dielectric is formed as a build-up process by successive lamination of dielectric films ranging in thickness between 15 microns and 50 microns. The lamination process may be carried out by hot-rolling a continuous film comprising a suitable material over the substrate.

Because similar processes are used in fabrication of both the package substrate and of the MWMP edge connector, MWMP edge connectors may be integrated onto the substrate at the time of fabrication, as part of the build-up process. Package substrates for MMICs may include directly integrated MWMP edge connectors.

In some embodiments, the substrate is a PCB supporting stripline or microline transmission lines and one or more IC dies. A dielectric overmold may be formed as a block of dielectric that at least partially covers the planar transmission lines and may pot any IC dies that are mounted on the substrate. The overmold material may comprise an epoxy composite that is flowed at an elevated temperature in a mold placed over the PCB substrate. The overmold may leave traces exposed near the edge of the substrate, terminating at planar pin plugs (e.g., pin plugs 701, FIG. 7B) at the substrate edge.

At operation 903, the build-up process includes formation of metallization for socket contacts. A sacrificial material is deposited over dielectric laminates. The sacrificial material may be a photoresist. In some embodiments, a photoresist layer is deposited by spray coating or spin coating. Patterning of the photoresist may be performed by exposure to ultraviolet light through a photomask. The pattern may be a negative pattern, where a negative tone resist is degraded where exposed to light, and openings in the resist layer are made in these features. A positive tone resist may be employed, where openings defining metallization features may be formed in shadowed regions. Metal may be deposited into the openings, covering the underlying dielectric. The photoresist may be a deposition mask to protect areas of dielectric from coverage by metal.

Several layers of sacrificial may be deposited to increase the thickness of the ensuing metallization structures. This may be performed by multilayer deposition of photoresist using a thick resist material. A solid film resist may be employed for this purpose. Thicknesses of a solid film resist may range between 30 microns and 100 microns. Alternatively, a thick liquid resist, such as, but not limited to, SU8, may be deposited by spin-coating, accompanied by a partial hardening bake operation.

Metallization features may be formed by a wet etch process to dissolve the photoresist in the exposed regions (positive tone) or in the unexposed regions (negative tone). The remaining photoresist may be an electroplating mask.

At operation 904, metallization structures, such as socket pins (e.g., socket pins 101 and 102, FIGS. 2A and 2B), are grown by electroplating in the openings formed in the sacrificial material in the previous operation. Deposition may be performed by electroplating of copper or other suitable metals into features defined in the sacrificial material. The electroplating operation may be preceded by deposition of a conductive seed layer. The conductive seed layer may have a thickness of 100 nm or less, and may comprise gold, copper, nickel, or tungsten. The metallization features may be formed to combine with pre-existing metal trace routing, such as stripline traces on the substrate.

At operation 905, the remaining sacrificial material may be removed. As an example, the photoresist mask formed in the previous operation may be stripped by any number of suitable stripping baths. The stripping process affects only photoresist as the sacrificial material, and may not disturb the underlying metal features nor the substrate dielectric. Metallization structures may be formed in layers. Minimum thicknesses of the metal layers may be 15 microns to 100 microns. For thicker structures, additional layers are plated over the metallization features. As an example, formation of 300 micron-thick ground socket pins may be require three electroplating operations through a 100 micron-thick electroplating mask.

For formation of thicker structures than possible with a single electroplating step, the process cycles back to operation 902, as indicated by the process return arrow, where a new dielectric layer is deposited. Succeeding operations 903, 904 and 905 may be followed as described above. The process may continue to cycle as shown in FIG. 9 until the structure is complete.

At operation 906, formation of socket pins and dielectric portions of the MWMP edge connector is completed. The connector may now be an integral component on the substrate.

Figure 10:
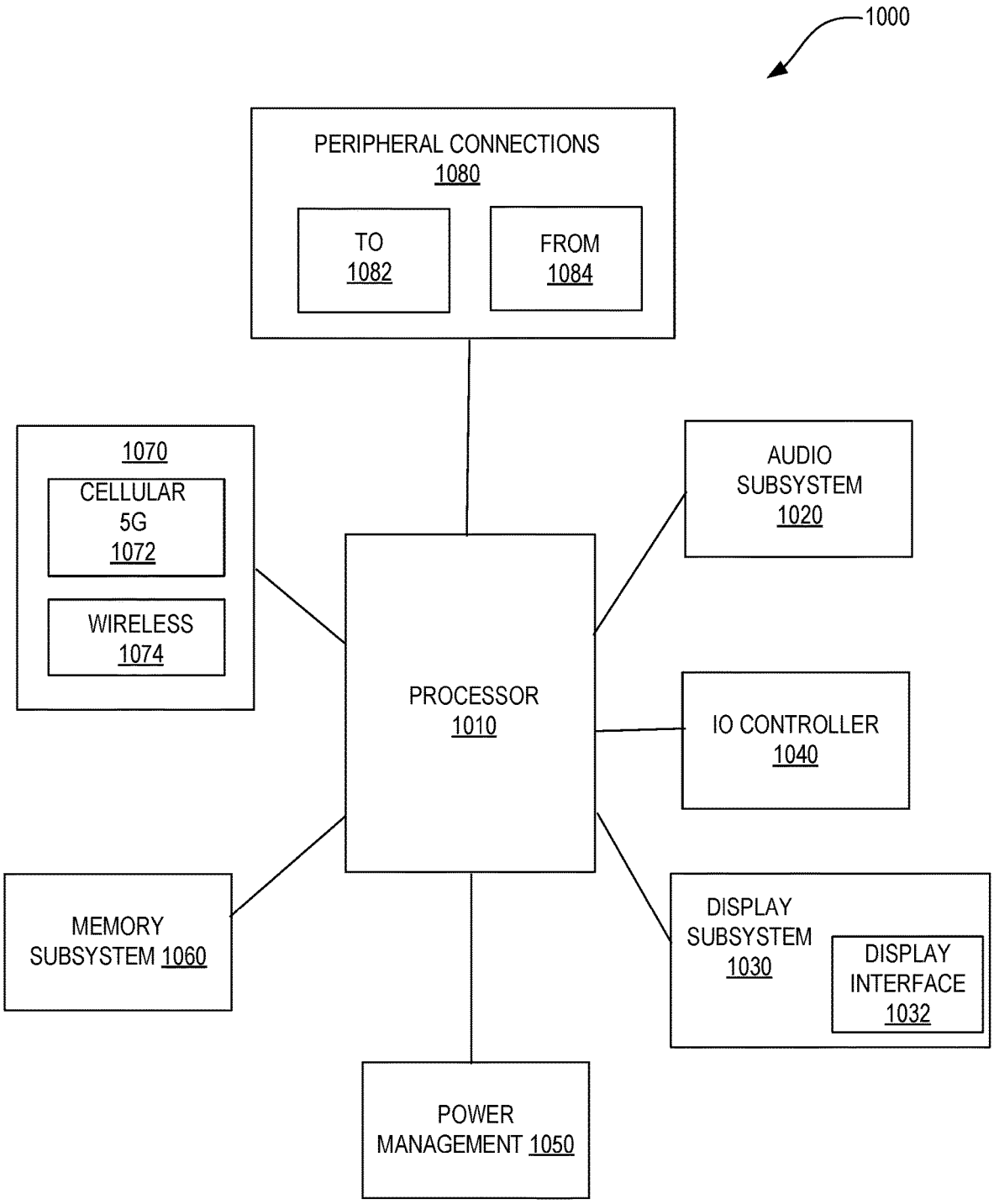
FIG. 10 illustrates a block diagram of a computing device as part of a system-on-chip (SoC) package in an implementation of a computing device, according to some embodiments of the disclosure.

FIG. 10 illustrates a block diagram of computing device 1000 as part of a system-on-chip (SoC) package in an implementation of a computing device, according to some embodiments of the disclosure.

According to some embodiments, computing device 1000 represents a server, a desktop workstation, or a mobile workstation, such as, but not limited to, a laptop computer, a computing tablet, a mobile phone or smart-phone, a wireless-enabled e-reader, or other wireless mobile device. An IC package, such as, but not limited to, a single- or multi-core microprocessor (e.g., representing a central processing unit.

In some embodiments, computing device has wireless connectivity (e.g., Bluetooth, WiFi and 5G network). It will be understood that certain components are shown generally, and not all components of such a device are shown in computing device 900.

The various embodiments of the present disclosure may also comprise a network interface within 1070 such as a wireless interface so that a system embodiment may be incorporated into a wireless device, for example, cell phone or personal digital assistant. The wireless interface includes a millimeter wave generator and antenna array. The millimeter wave generator may be part of a monolithic microwave integrated circuit, comprising a MWMP edge connector (e.g., MWMP edge connector 400)

According to some embodiments, processor 1010 represents a CPU or a GPU, and can include one or more physical devices, such as microprocessors, application processors, microcontrollers, programmable logic devices, or other processing means. The processing operations performed by processor 1010 include the execution of an operating platform or operating system on which applications and/or device functions are executed. The processing operations include operations related to I/O (input/output) with a human user or with other devices, operations related to power management, and/or operations related to connecting the computing device 1000 to another device. The processing operations may also include operations related to audio I/O and/or display I/O.

In one embodiment, computing device 1000 includes audio subsystem 1020, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into computing device 1000, or connected to the computing device 1000. In one embodiment, a user interacts with the computing device 1000 by providing audio commands that are received and processed by processor 1010

Display subsystem 1030 represents hardware (e.g., display devices) and software (e.g., drivers) components that provide a visual and/or tactile display for a user to interact with the computing device 1000. Display subsystem 1030 includes display interface 1032 which includes the particular screen or hardware device used to provide a display to a user. In one embodiment, display interface 1032 includes logic separate from processor 1010 to perform at least some processing related to the display. In one embodiment, display subsystem 1030 includes a touch screen (or touch pad) device that provides both output and input to a user.

I/O controller 1040 represents hardware devices and software components related to interaction with a user. I/O controller 1040 is operable to manage hardware that is part of audio subsystem 1020 and/or display subsystem 1030. Additionally, I/O controller 1040 illustrates a connection point for additional devices that connect to computing device 1000 through which a user might interact with the system. For example, devices that can be attached to the computing device 1000 might include microphone devices, speaker or stereo systems, video systems or other display devices, keyboard or keypad devices, or other I/O devices for use with specific applications such as card readers or other devices.

As mentioned above, I/O controller 1040 can interact with audio subsystem 1020 and/or display subsystem 1030. For example, input through a microphone or other audio device can provide input or commands for one or more applications or functions of the computing device 1000. Additionally, audio output can be provided instead of, or in addition to display output. In another example, if display subsystem 1030 includes a touch screen, the display device also acts as an input device, which can be at least partially managed by I/O controller 1040. There can also be additional buttons or switches on the computing device 1000 to provide I/O functions managed by I/O controller 1040.

In one embodiment, I/O controller 1040 manages devices such as accelerometers, cameras, light sensors or other environmental sensors, or other hardware that can be included in the computing device 1000. The input can be part of direct user interaction, as well as providing environmental input to the system to influence its operations (such as filtering for noise, adjusting displays for brightness detection, applying a flash for a camera, or other features).

In one embodiment, computing device 1000 includes power management 1050 that manages battery power usage, charging of the battery, and features related to power saving operation. Memory subsystem 1060 includes memory devices for storing information in computing device 1000. Memory can include nonvolatile (state does not change if power to the memory device is interrupted) and/or volatile (state is indeterminate if power to the memory device is interrupted) memory devices. Memory subsystem 1060 can store application data, user data, music, photos, documents, or other data, as well as system data (whether long-term or temporary) related to the execution of the applications and functions of the computing device 1000.

Elements of embodiments are also provided as a machine-readable medium (e.g., memory 1060) for storing the computer-executable instructions. The machine-readable medium (e.g., memory 1060) may include, but is not limited to, flash memory, optical disks, CD-ROMs, DVD ROMs, RAMs, EPROMs, EEPROMs, magnetic or optical cards, phase change memory (PCM), or other types of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

Connectivity via network interface 1070 includes hardware devices (e.g., wireless and/or wired connectors and communication hardware) and software components (e.g., drivers, protocol stacks) to enable the computing device 1000 to communicate with external devices. The computing device 1000 could be separate devices, such as other computing devices, wireless access points or base stations, as well as peripherals such as headsets, printers, or other devices.

Network interface 1070 can include multiple different types of connectivity. To generalize, the computing device 1000 is illustrated with cellular connectivity 1072 and wireless connectivity 1074. Cellular connectivity 1072 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, or other cellular service standards. Wireless connectivity (or wireless interface) 1074 refers to wireless connectivity that is not cellular, and can include personal area networks (such as Bluetooth, Near Field, etc.), local area networks (such as Wi-Fi), and/or wide area networks (such as WiMax), or other wireless communication.

Peripheral connections 1080 include hardware interfaces and connectors, as well as software components (e.g., drivers, protocol stacks) to make peripheral connections. It will be understood that the computing device 1000 could both be a peripheral device ("to" 1082) to other computing devices, as well as have peripheral devices ("from" 1084) connected to it. The computing device 1000 commonly has a "docking" connector to connect to other computing devices for purposes such as managing (e.g., downloading and/or uploading, changing, synchronizing) content on computing device 1000. Additionally, a docking connector can allow computing device 1000 to connect to certain peripherals that allow the computing device 1000 to control content output, for example, to audiovisual or other systems.

In addition to a proprietary docking connector or other proprietary connection hardware, the computing device 1000 can make peripheral connections 1080 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other types.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. The embodiments of the disclosure are intended to embrace all such alternatives, modifications, and variations as to fall within the broad scope of the appended claims.

In addition, well known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to implementation of such block diagram arrangements are highly dependent upon the platform within which the present disclosure is to be implemented (i.e., such specifics should be well within purview of one skilled in the art). Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

The following examples pertain to further embodiments. Specifics in the examples may be used anywhere in one or more embodiments. All optional features of the apparatus described herein may also be implemented with respect to a method or process.

Example 1 is a wide bandwidth signal connector plug, comprising a plurality of signal pins comprising a first anchor portion and a first mating portion; and a plurality of ground pins comprising a second anchor portion and a second mating portion, wherein the plurality of ground pins is adjacent to the plurality of signal pins, and wherein the plurality of signal pins has a first thickness and the plurality of ground pins has a second thickness that is greater than the first thickness; and the first anchor portion has a first width and the second anchor portion has a second width that is greater than the first width.

Example 2 has all of the features of example 1, wherein the first anchor portion is elongate, and has third width that is tapered between a first end and a second end, wherein the first end is proximal to the edge of the housing.

Example 3 includes all of the features of example 1, wherein the first mating portion is elongate, and has a fourth width that is tapered between a third end and a fourth end, wherein the third end is proximal to the edge of the housing.

Example 4 includes all of the features of example 3, wherein the fourth width comprises a corrugation.

Example 5 includes all of the features of example 3, wherein the fourth width is orthogonal to the first width.

Example 6 includes all of the features of example 3, wherein the fourth width is parallel to the first width.

Example 7 includes all of the features of any one of examples 1 through 6, wherein the first anchor portion is bent out of a plane of the first mating portion.

Example 8 includes all of the features of any one of examples 1 through 7, wherein the second anchor portion has a tabular shape, and wherein the tabular shape is rectangular.

Example 9 is a wide bandwidth signal connector socket, comprising a socket housing comprising a dielectric; a plurality of socket signal pins, wherein the plurality of socket signal pins has a first socket mating portion protruding from an edge of the socket housing, the first socket mating portion extends from a first socket anchor portion within the dielectric; and a plurality of socket ground pins adjacent to the plurality of socket signal pins, the plurality of socket ground pins having a second socket mating portion protruding from the edge of the housing, the second socket mating portion extends from a second socket anchor portion within the dielectric, wherein the plurality of socket signal pins has a first thickness and the plurality of socket ground pins has a second thickness that is greater than the first thickness; and the second socket mating portion has a first width and the second socket anchor portion has a second width that is greater than the first width.

Example 10 includes all of the features of example 9, wherein the first socket mating portion comprises a first prong and a second prong extending from the first socket anchor portion, wherein the first prong has a first corrugation and the second prong has a second corrugation that is opposite the first corrugation.

Example 11 includes all of the features of examples 9 or 10, wherein the first prong and the second prong each have a proximal end adjacent to the first socket anchor portion and a distal end opposite the proximal end, and wherein the first prong and the second prong are separated by a gap, and wherein the gap is tapered from the distal end to the proximal end.

Example 12 includes all of the features of any one of examples 9 through 11, wherein the distal end of the gap comprises a corrugated portion.

Example 13 includes all of the features of any one of examples 9 through 12, wherein the second socket mating portion comprises a third prong and a fourth prong extending from the second socket anchor portion, wherein the wherein the third prong has a third corrugation and the fourth prong has a fourth corrugation that is opposite the third corrugation.

Example 14 includes all of the features of any one of examples 9 through 13, wherein the third prong and the fourth prong each have a proximal end adjacent to the second socket anchor portion and a distal end opposite the proximal end, and wherein the third prong and the fourth prong are separated by a gap, and wherein the gap is tapered from the distal end to the proximal end.

Example 15 includes all of the features of any one of examples 9 through 14, wherein the fourth width is orthogonal to the first width.

Example 16 includes all of the features of any one of examples 9 through 15, wherein the fourth width is parallel to the first width.

Example 17 includes all of the features of any one of examples 9 through 16, wherein the first socket anchor portion is bent out of a plane of the first socket mating portion.

Example 18 includes all of the features of any one of example 9 through 17, wherein the second socket anchor portion has a tabular shape, and wherein the tabular shape is rectangular.

Example 19 is a system comprising a first plurality of parallel conductors coupled to a wide-bandwidth signal connector plug, wherein the wide-bandwidth signal connector plug comprises a plug housing comprising a dielectric; a plurality of plug signal pins, wherein the plurality of plug signal pins has a first plug mating portion protruding from an edge of the plug housing, the first plug mating portion extends from a first plug anchor portion within the dielectric; and a plurality of plug ground pins adjacent to the plurality of plug signal pins, the plurality of plug ground pins having a second plug mating portion protruding from the edge of the plug housing, the second plug mating portion extends from a second plug anchor portion within the dielectric, wherein the plurality of plug signal pins has a first thickness and the plurality of plug ground pins has a second thickness that is greater than the first thickness; and the second plug mating portion has a first width and the second plug anchor portion has a second width that is greater than the first width; and a second plurality of parallel conductors electrically coupled to a wide-bandwidth signal connector socket, wherein the wide-bandwidth signal connector socket comprises a socket housing comprising the dielectric; a plurality of socket signal pins, wherein the plurality of socket signal pins has a first socket mating portion protruding from an edge of the socket housing, the first socket mating portion extends from a first socket anchor portion within the dielectric; and a plurality of socket ground pins adjacent to the plurality of socket signal pins, the plurality of socket ground pins having a second socket mating portion protruding from the edge of the housing, the second socket mating portion extends from a second socket anchor portion within the dielectric, wherein the plurality of socket signal pins has a first thickness and the plurality of socket ground pins has a second thickness that is greater than the first thickness; and the second socket mating portion has a first width and the second socket anchor portion has a second width that is greater than the first width, wherein the plurality of plug signal pins is electrically coupled to the plurality of socket signal pins, and the plurality of plug ground pins is electrically coupled to the plurality of socket ground pins.

Example 20 includes all of the features of example 19, wherein the high-bandwidth signal connector plug and the high-bandwidth signal connector socket have a characteristic impedance of approximately 50 ohms.

Example 21 includes all of the features of examples 19 or 20, wherein the wide-bandwidth signal connector socket is electrically coupled to a cable comprising the second plurality of parallel conductors, and wherein the wide-bandwidth signal connector plug is electrically coupled to a rigid substrate comprising the first plurality of parallel conductors.

Example 22 includes all of the features of any one of examples 19 through 21, wherein the wide-bandwidth signal connector socket is electrically coupled to a rigid substrate comprising the second plurality of parallel conductors, and wherein the wide-bandwidth signal connector plug is electrically coupled to a cable comprising the first plurality of parallel conductors.

Example 23 includes all of the features of any one of examples 19 through 22, wherein the wide-bandwidth signal connector plug is electrically coupled to a first rigid substrate comprising the first plurality of parallel conductors, and wherein the wide-bandwidth signal connector socket is electrically coupled to a second rigid substrate comprising the second plurality of parallel conductors.

Example 24 includes all of the features of any one of examples 19 through 23, wherein the high-bandwidth signal connector plug is mechanically coupled to the high-bandwidth signal connector socket, wherein the plurality of plug signal pins is mated to the plurality of socket signal pins, and the plurality of plug ground pins is mated to the plurality of socket ground pins.

Example 25 includes all of the features of any one of examples 19 through 24, wherein the rigid substrate comprises an integrated antenna, wherein the integrated antenna is electrically coupled to the high-bandwidth signal connector plug and to the high-bandwidth signal connector socket.

Example 26 includes all of the features of any one of examples 21 through 25, wherein the rigid substrate is a printed circuit board or a package substrate.

Example 27 includes all of the features of any one of examples 21 through 26, wherein the wide-bandwidth signal connector plug is on an edge of the rigid substrate.

Example 28 includes all of the features of example 27, wherein the rigid substrate comprises a plurality of traces having a terminal portion at the edge of the rigid substrate, and wherein terminal portions of the plurality of traces comprise the plurality of plug signal pins and the plurality of plug ground pins at the edge of the rigid substrate.

Example 29 includes all of the features of example 28, wherein a mold material is over the plurality of traces, wherein the plurality of plug signal pins and the plurality of ground signal pins is on the mold material above the plurality of traces, and wherein the plurality of plug signal pins and plug ground pins is electrically coupled to the plurality of traces by a plurality of vias extending through the mold material.

Example 30 is a method for making a wide-bandwidth signal connector socket, comprising forming a first dielectric film on a substrate; forming a first pattern of openings in the first dielectric film; forming a first conductive layer over the first dielectric film, wherein the first conductive layer fills the first pattern of openings; forming and patterning a sacrificial film over the first conductive layer; forming a second dielectric film over the sacrificial film; forming a second pattern of openings in the second dielectric film; forming a second conductive layer over the second dielectric film, wherein the second conductive layer fills the second pattern of openings; and removing the sacrificial film.

An abstract is submitted with the understanding that it will not be used to limit the scope or meaning of the claims. The following claims are hereby incorporated into the detailed description, with each claim standing on its own as a separate embodiment.

We claim:

1. A signal connector plug, comprising:

a plug housing;

a plurality of signal plug pins, individual ones of the signal plug pins comprising a first plug anchor portion within the plug housing and a first plug mating portion extending from the first plug anchor portion and protruding from an edge of the plug housing; and a plurality of ground plug pins, individual ones of the ground plug pins comprising a second plug anchor portion within the plug housing and a second plug mating portion extending from the second plug anchor portion and protruding from the edge of the plug housing, wherein individual ones of the ground plug pins are between individual ones of the signal plug pins, and wherein:

each of the plurality of signal plug pins has a first thickness and each of the plurality of ground plug pins has a second thickness that is greater than the first thickness; and the first plug anchor portion has a first width and the second plug anchor portion has a second width that is greater than the first width.

2. The signal connector plug of claim 1, wherein the first plug anchor portion is elongate, and has third width that is tapered between a first end and a second end, and wherein the first end is proximal to the edge of the plug housing.

3. The signal connector plug of claim 1, wherein the first plug mating portion is elongate, and has a fourth width that is tapered between a third end and a fourth end, and wherein the third end is proximal to the edge of the plug housing.

4. The signal connector plug of claim 3, wherein the fourth width comprises a corrugation.

5. The signal connector plug of claim 1, wherein a centerline through the first plug mating portions is substantially coincident with a centerline through the second plug mating portions.

6. The signal connector plug of claim 1, wherein the first plug anchor portion extends out of a plane of the first plug mating portion.

7. The signal connector plug of claim 1, wherein the second plug anchor portion has a tabular shape, and wherein the tabular shape is rectangular.

8. A signal connector socket, comprising:

a socket housing;

a plurality of signal socket pins, individual ones of the signal socket pins comprising a first socket anchor portion within the socket housing and a first socket mating portion extending from the first socket anchor portion and protruding from an edge of the socket housing; and a plurality of ground socket pins, individual ones of the ground socket pins comprising a second socket anchor portion within the socket housing and a second socket mating portion extending from the second socket anchor portion and protruding from the edge of the socket housing, wherein individual ones of the ground socket pins are between individual ones of the signal socket pins, and wherein:

each of the plurality of signal socket pins has a first thickness and each of the plurality of socket ground pins has a second thickness that is greater than the first thickness; and the first socket mating portion has a first width and the second socket anchor portion has a second width that is greater than the first width.

9. The signal connector socket of claim 8, wherein the first socket mating portion comprises a first prong and a second prong extending from the first socket anchor portion, wherein the first prong has a first corrugation and the second prong has a second corrugation that is opposite the first corrugation.

10. The signal connector socket of claim 9, wherein the first prong and the second prong each have a proximal end adjacent to the first socket anchor portion and a distal end opposite the proximal end, and wherein the first prong and the second prong are separated by a gap, and wherein the gap is tapered from the distal end to the proximal end.

11. The signal connector socket of claim 8, wherein the second socket mating portion comprises a third prong and a fourth prong extending from the second socket anchor portion, wherein the wherein the third prong has a third corrugation and the fourth prong has a fourth corrugation that is opposite the third corrugation.

12. The signal connector socket of claim 11, wherein the third prong and the fourth prong each have a proximal end adjacent to the second socket anchor portion and a distal end opposite the proximal end, and wherein the third prong and the fourth prong are separated by a gap, and wherein the gap is tapered from the distal end to the proximal end.

13. The signal connector socket of claim 8, wherein the first socket anchor portion extends out of a plane of the first socket mating portion.

14. The signal connector socket of claim 8, wherein the second socket anchor portion has a tabular shape, and wherein the tabular shape is rectangular.

15. A system comprising:

a first plurality of parallel conductors coupled to a signal connector plug, wherein the signal connector plug comprises:

a plug housing;

a plurality of signal plug pins, individual ones of the signal plug pins comprising a first plug anchor portion within the plug housing and a first plug mating portion extending from the first plug anchor portion and protruding from an edge of the plug housing; and a plurality of ground plug pins, individual ones of the ground plug pins comprising a second plug anchor portion within the plug housing and a second plug mating portion extending from the second plug anchor portion and protruding from the edge of the plug housing, wherein individual ones of the ground plug pins are between individual ones of the signal plug pins, and wherein:

each of the plurality of signal plug pins has a first thickness and each of the plurality of ground plug pins has a second thickness that is greater than the first thickness; and the first plug anchor portion has a first width and the second plug anchor portion has a second width that is greater than the first width; and a second plurality of parallel conductors electrically coupled to a signal connector socket, wherein the signal connector socket comprises:

a socket housing;

a plurality of signal socket pins, individual ones of the signal socket pins comprising a first socket anchor portion within the socket housing and a first socket mating portion extend from the first socket anchor portion and protruding from an edge of the socket housing; and a plurality of ground socket pins, individual ones of the ground socket pins comprising a second socket anchor portion within the socket housing and a second socket mating portion extending from the second socket anchor portion and protruding from the edge of the socket housing, wherein individual ones of the ground socket pins are between individual ones of the signal socket pins, and wherein:

each of the plurality of signal socket pins has a first thickness and each of the plurality of socket ground pins has a second thickness that is greater than the first thickness; and the first socket mating portion has a first width and the second socket anchor portion has a second width that is greater than the first width, wherein the plurality of signal plug pins is electrically coupled to the plurality of signal socket pins, and the plurality of ground plug pins is electrically coupled to the plurality of ground socket pins.

16. The system of claim 15, wherein the signal connector plug and the signal connector socket have a characteristic impedance of approximately 50 ohms.

17. The system of claim 15, wherein the signal connector socket is electrically coupled to a cable comprising the second plurality of parallel conductors, and wherein the signal connector plug is electrically coupled to a rigid substrate comprising the first plurality of parallel conductors.

18. The system of claim 15, wherein:

the signal connector socket is electrically coupled to a rigid substrate comprising the second plurality of parallel conductors, and wherein the signal connector plug is electrically coupled to a cable comprising the first plurality of parallel conductors; or the signal connector plug is electrically coupled to a first rigid substrate comprising the first plurality of parallel conductors, and wherein the signal connector socket is electrically coupled to a second rigid substrate comprising the second plurality of parallel conductors.

19. The system of claim 15, wherein:

the rigid substrate is a printed circuit board or a package substrate; or the rigid substrate comprises an integrated antenna, wherein the integrated antenna is electrically coupled to the signal connector plug and to the signal connector socket.

20. The system of claim 19, wherein the rigid substrate comprises a plurality of traces having a terminal portion at the edge of the rigid substrate, and wherein terminal portions of the plurality of traces comprise the plurality of signal plug pins and the plurality of ground plug pins at the edge of the rigid substrate.

21. The system of claim 20, wherein a mold material is over the plurality of traces, wherein the plurality of signal plug pins and the plurality of signal ground pins is on the mold material above the plurality of traces, and wherein the plurality of signal plug pins and ground plug pins is electrically coupled to the plurality of traces by a plurality of vias extending through the mold material.

* * * * *